US010759198B2

(12) United States Patent
Snyder et al.

(10) Patent No.: US 10,759,198 B2
(45) Date of Patent: Sep. 1, 2020

(54) INK JET CARD PRINTER HAVING A CARD POSITION SENSOR

(71) Applicant: Assa Abloy AB, Stockholm (SE)

(72) Inventors: Tanya Snyder, Edina, MN (US); Daniel Fowell, Chaska, MN (US); Brent Lien, Minneapolis, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/265,292

(22) Filed: Feb. 1, 2019

(65) Prior Publication Data

US 2020/0247149 A1 Aug. 6, 2020

(51) Int. Cl.
*B41J 11/00* (2006.01)
*B41J 13/08* (2006.01)
(Continued)

(52) U.S. Cl.
CPC ..... *B41J 11/0095* (2013.01); *B41J 3/62* (2013.01); *B41J 11/007* (2013.01); *B41J 11/008* (2013.01); *B41J 11/0065* (2013.01); *B41J 13/0009* (2013.01); *B41J 13/08* (2013.01); *B41J 13/26* (2013.01); *B65H 5/021* (2013.01); *B65H 5/04* (2013.01); *B65H 9/00* (2013.01);
(Continued)

(58) Field of Classification Search
CPC ..... B41J 11/0095; B41J 13/26; B41J 11/008; B41J 3/62; B41J 11/0065; B41J 13/0009; B41J 13/08; B41J 11/007; B41J 3/60; B41J 11/0085; B65H 9/004; B65H 9/04; B65H 9/101; B65H 9/10; B65H 5/04; B65H 9/00; B65H 5/021; B65H 5/062; B65H 2701/1914; B65H 5/06
See application file for complete search history.

(56) References Cited

U.S. PATENT DOCUMENTS 6,137,989 A 10/2000 Quesnel
6,753,975 B1 6/2004 Hanson
(Continued)

FOREIGN PATENT DOCUMENTS

EP 1881903 A1 1/2008
EP 3147132 A2 3/2017
(Continued)

OTHER PUBLICATIONS

"European Application Serial No. 20154541.5, Extended European Search Report dated May 20, 2020", 12 pgs.

*Primary Examiner* — Justin Seo
(74) *Attorney, Agent, or Firm* — Schwegman Lundberg & Woessner, P.A.

(57) ABSTRACT

In a method of operating an ink jet card printer, which includes a transport belt, a print unit including an ink jet print head, a sensor and a gantry, a card is loaded onto the transport belt along a processing axis using an exposed surface of the transport belt. The sensor and the ink jet print head are moved relative to the card using the gantry. A current position of the card is detected using the sensor. An image is printed to the card using the ink jet print head when the detected current position of the card indicates that the card is supported on the transport belt in a print position. Printing is interrupted when the detected current position of the card indicates that the card is not in the print position.

16 Claims, 14 Drawing Sheets

(51) Int. Cl.

| | |
|---|---|
| ***B41J 13/00*** | (2006.01) |
| ***B41J 3/62*** | (2006.01) |
| ***B65H 5/02*** | (2006.01) |
| ***B65H 9/00*** | (2006.01) |
| ***B65H 5/04*** | (2006.01) |
| ***B65H 9/10*** | (2006.01) |
| ***B65H 9/04*** | (2006.01) |
| ***B41J 13/26*** | (2006.01) |
| *B41J 3/60* | (2006.01) |
| *B65H 5/06* | (2006.01) |

(52) U.S. Cl.

CPC ..... *B65H 9/004* (2013.01); *B65H 9/04* (2013.01); *B65H 9/10* (2013.01); *B65H 9/101* (2013.01); *B41J 3/60* (2013.01); *B41J 11/0085* (2013.01); *B65H 5/06* (2013.01); *B65H 5/062* (2013.01); *B65H 2701/1914* (2013.01)

(56) References Cited

U.S. PATENT DOCUMENTS

| | | | | |
|---|---|---|---|---|
| 6,895,210 | B1 | 5/2005 | Quesnel | |
| 6,945,721 | B2 | 9/2005 | Sato | |
| 7,154,519 | B2 | 12/2006 | Meier et al. | |
| 7,156,482 | B2 | 1/2007 | Boleda et al. | |
| 7,367,642 | B2 | 5/2008 | Ouchi et al. | |
| 7,533,959 | B2 | 5/2009 | Ouchi et al. | |
| 7,641,301 | B2 | 1/2010 | Hayamizu et al. | |
| 8,714,688 | B2 | 5/2014 | Saikawa et al. | |
| 8,724,131 | B2 | 5/2014 | Young | |
| 8,851,612 | B2 | 10/2014 | Yatsunami | |
| 8,881,653 | B2 | 11/2014 | Yamauchi | |
| 9,016,828 | B2 | 4/2015 | Yatsunami | |
| 2004/0036726 | A1 | 2/2004 | Zach | |
| 2005/0078998 | A1 | 4/2005 | Lien et al. | |
| 2005/0200680 | A1 | 9/2005 | Uchida | |
| 2007/0206038 | A1 | 9/2007 | Baker | |
| 2010/0141975 | A1* | 6/2010 | Takaki ..... | B41J 11/008 358/1.12 |
| 2013/0074720 | A1 | 3/2013 | Yamauchi | |

FOREIGN PATENT DOCUMENTS

| | | | |
|---|---|---|---|
| EP | 3156241 | A1 | 4/2017 |
| WO | WO-2019116079 | A1 | 6/2019 |

* cited by examiner

INK JET CARD PRINTER HAVING A CARD POSITION SENSOR

BACKGROUND

Card products include, for example, credit cards, identification cards, driver's licenses, passports, and other card products. Such card products generally include printed information, such as a photo, account numbers, identification numbers, and other personal information. Credentials can also include data that is encoded in a smartcard chip, a magnetic stripe, or a barcode, for example.

Card production systems include processing devices that process card substrates (hereinafter "cards") to form the final card product. Such processes may include a printing process, a laminating or transfer process, a data reading process, a data writing process, and/or other process used to form the desired credential. An ink jet card printer is a form of card production system that utilizes an ink jet print head to print images to cards.

SUMMARY

Embodiments of the present disclosure are directed an ink jet card printer having a card sensor and methods of operating the ink jet card printer. The ink jet card printer includes a transport belt, a print unit including an ink jet print head, the sensor and a gantry that supports the ink jet print head and the sensor for movement relative to the transfer belt. In one exemplary method, a card is loaded onto the transport belt by driving the card along a processing axis using an exposed surface of the transport belt. The sensor and the ink jet print head are moved relative to the card using the gantry. A current position of the card relative to the processing axis is detected using the sensor. An image is printed to the card using the ink jet print head when the detected current position of the card indicates that the card is supported on the transport belt in a print position. Printing an image to the card using the ink jet print head is interrupted when the detected current position of the card indicates that the card is not in the print position.

Another exemplary method is directed to the operation of an ink jet card printer having a card transport including first and second belts, and a print unit including an ink jet print head, a sensor and a gantry. In the method, a first card is loaded onto the first belt by driving the first card along a processing axis using an exposed surface of the first belt. A second card is loaded onto the second belt by driving the second card along a processing axis using an exposed surface of the second belt. The sensor and the ink jet print head are moved relative to the first and second cards using the gantry. Current positions of the first and second cards relative to the processing axis are detected using the sensor. A first image is printed to the first card and a second image is printed to the second card using the ink jet print head when the detected current positions of the first and second cards indicate that the first card is supported on the first belt in a first print position, and the second card is supported on the second belt in a second print position. Printing images to the first and second cards is interrupted when the detected current position of the first card indicates that the first card is not in the first print position, or when the detected current position of the second card indicates that the second card is not in the second print position.

One exemplary embodiment of the ink jet card printer includes a card transport, a print unit, and a controller. The card transport includes a transport belt having an exposed surface configured engage and feed a card along a processing axis. The print unit includes an ink jet print head, a sensor and a gantry. The gantry is configured to move the ink jet print head and the sensor along a fast scan axis that is parallel to the processing axis and a slow scan axis that is perpendicular to the processing axis. The controller is configured to load a card onto the transport belt, detect a current position of the card relative to the processing axis using the sensor, print an image to the card using the ink jet print head when the detected current position of the card indicates that the card is supported on the transport belt in a print position, and interrupt printing an image to the card using the ink jet print head when the detected current position of the card indicates that the card is not in the print position.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
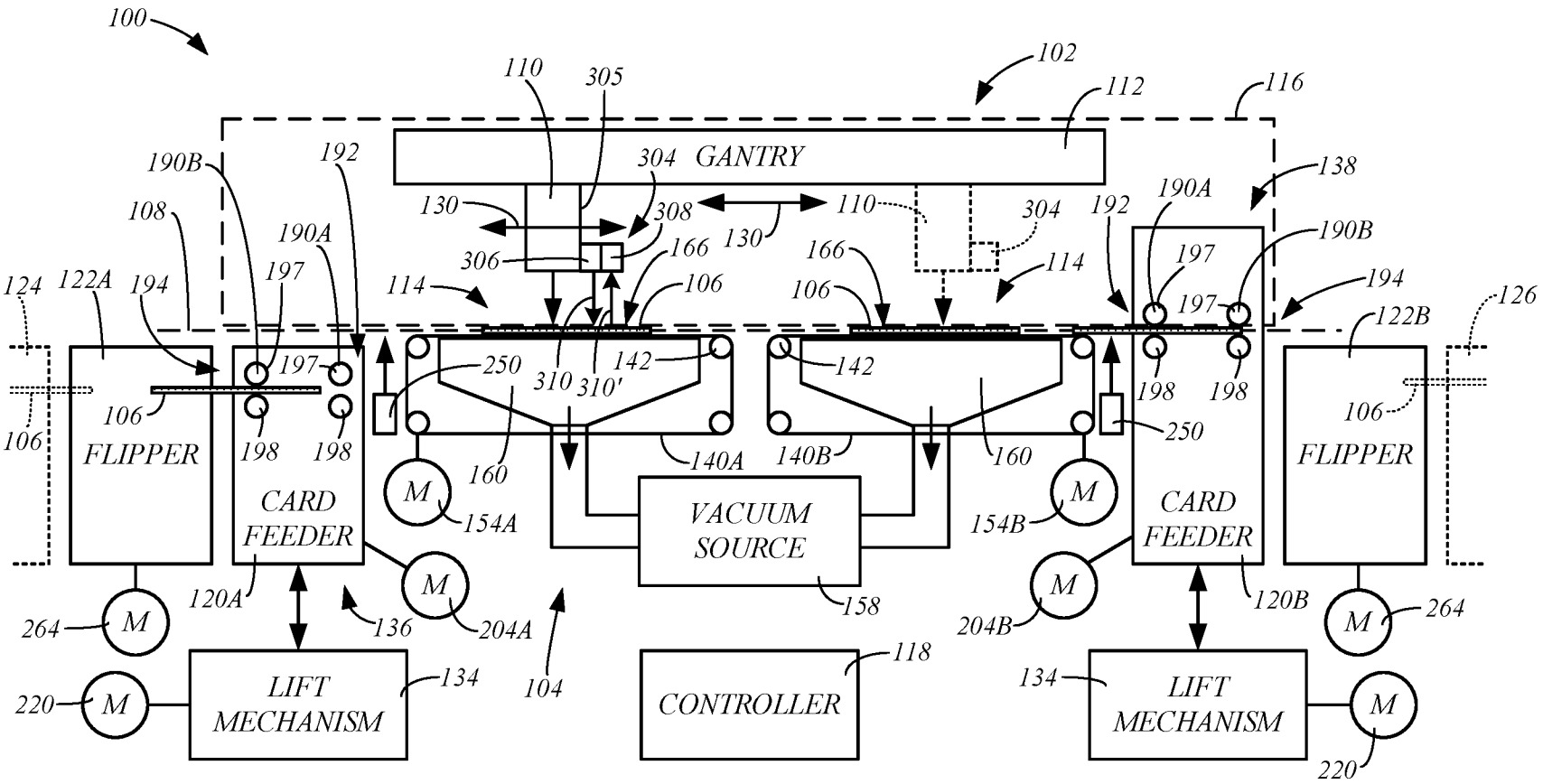
FIGS. 1 and 2 are simplified side and top views of an ink jet card printer, in accordance with embodiments of the present disclosure.

Embodiments of the present disclosure are generally directed to a card feeder of an ink jet card printer that is configured to facilitate the feeding individual cards to a print position for printing by an ink jet print head that is moved through a print zone using a gantry during printing operations. The card feeder has a raised position, in which at least a portion of the card feeder extends into the print zone. As a result, the card feeder would obstruct printing operations if left in the raised position. This issue is avoided by moving the card feeder to a lowered position during printing operations, in which the card feeder is displaced from the print zone, using a lift mechanism.

These and other embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Figure 2:
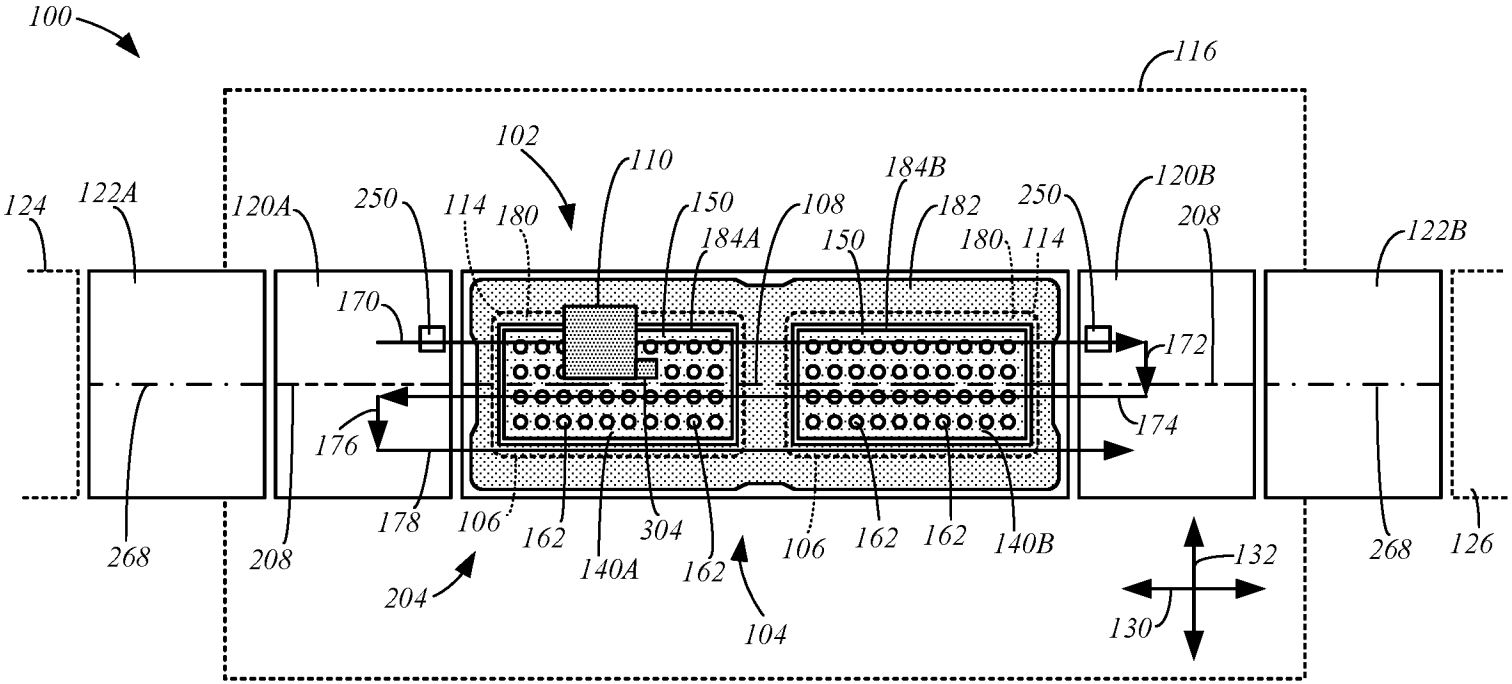

FIGS. 1 and 2 are simplified side and top views of an ink jet card printer 100 in accordance with embodiments of the present disclosure. In some embodiments, the printer 100 includes a print unit 102, and a card transport 104. The card transport 104 is configured to feed individual cards 106 along a processing axis 108. The print unit 102 includes an ink jet print head 110 and a gantry 112. The print head 110 is configured to perform a printing operation on individual cards 106 supported by the card transport 104 in a print position 114 along the processing axis 108. The gantry 112 is configured to move the print head 110 through a print zone 116 during printing operations.

In some embodiments, the printer 100 includes a controller 118, which represents one or more distinct controllers of the printer 100, each of which includes at least one processor that is configured to execute program instructions stored in a computer-readable media or memory of the printer 100, which may also be represented by the controller 118, or another location. Any suitable patent subject matter eligible computer readable media or memory may be utilized including, for example, hard disks, CD-ROMS, optical storage devices, flash memory, magnetic storage devices, or other suitable computer readable media or memory that do not include transitory waves or signals. The execution of the instructions by the controller 118 controls components of the printer 100 to perform functions and method steps described herein.

As discussed in greater detail below, the card printer 100 may include one or more card feeders 120, such as card feeders 120A and 120B, that are each configured to deliver cards 106 to, and receive cards 106 from, the card transport 104. The printer 100 may also include one or more conventional card flippers 122, such as flippers 122A and 122B, that are configured to invert the cards 106. A conventional card supply 124, such as a card cartridge containing a stack of cards, may be provided to supply cards 106 for processing by the printer 100, and processed cards may be discharged and collected by a suitable card collector (e.g., a hopper) 126.

The ink jet print head 110 may be any suitable conventional ink jet print head that is configured to perform a direct printing operation to individual cards 106 supported in the print positions 114 along the processing axis 108. The gantry 112 includes a conventional gantry for moving the print head 110 along a fast scan axis 130 that is substantially parallel to the processing axis 108, and a slow scan axis 132 that is substantially perpendicular to the processing axis 108, as shown in FIG. 2, during printing operations. As used herein, the term "fast scan axis" refers to the axis along which the print head 110 is moved by the gantry 112 during an active printing phase of the operation, during which ink is discharged from the print head 110 to form the image on the card 106. The term "slow scan axis" refers to the axis along which the print head 110 is moved by the gantry 112 during an inactive printing phase (ink is not discharged from the print head) to position the print head 110 for the next active printing phase.

In some embodiments, the gantry 112 and the print head 110 may occupy the print zone 116 during printing operations, which is indicated by dashed boxes in FIGS. 1 and 2. The print zone 116 generally extends from the processing axis 108, or immediately above the processing axis 108, into the space above the card transport 104 and the card feeders 120. The print zone 116 may also surround the card transport 104 and the card feeders 120, as shown in FIG. 2.

Figure 3:
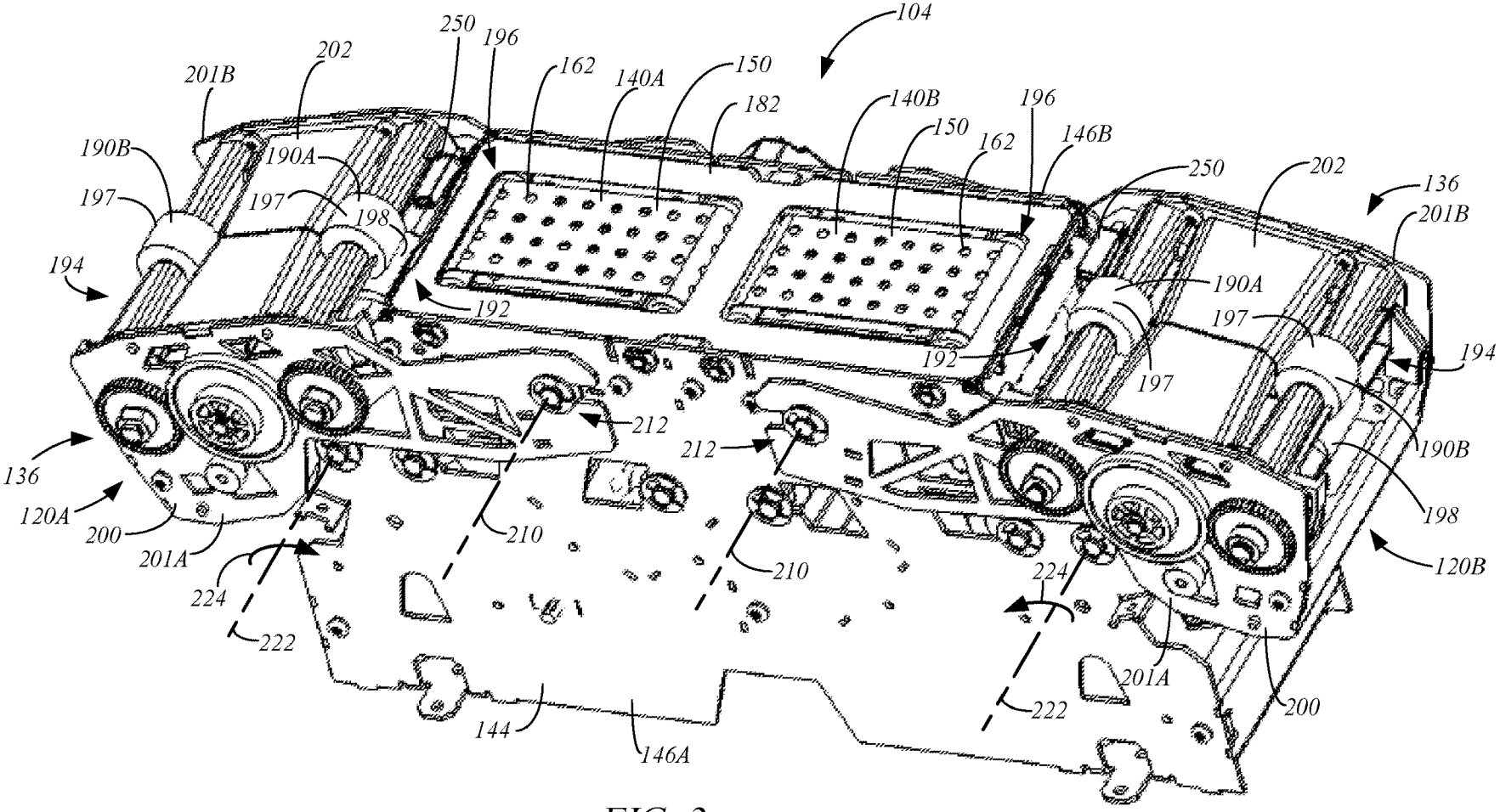
FIG. 3 is an isometric view of an exemplary card transport and card feeders (lowered positions), in accordance with embodiments of the present disclosure.
Figure 4:
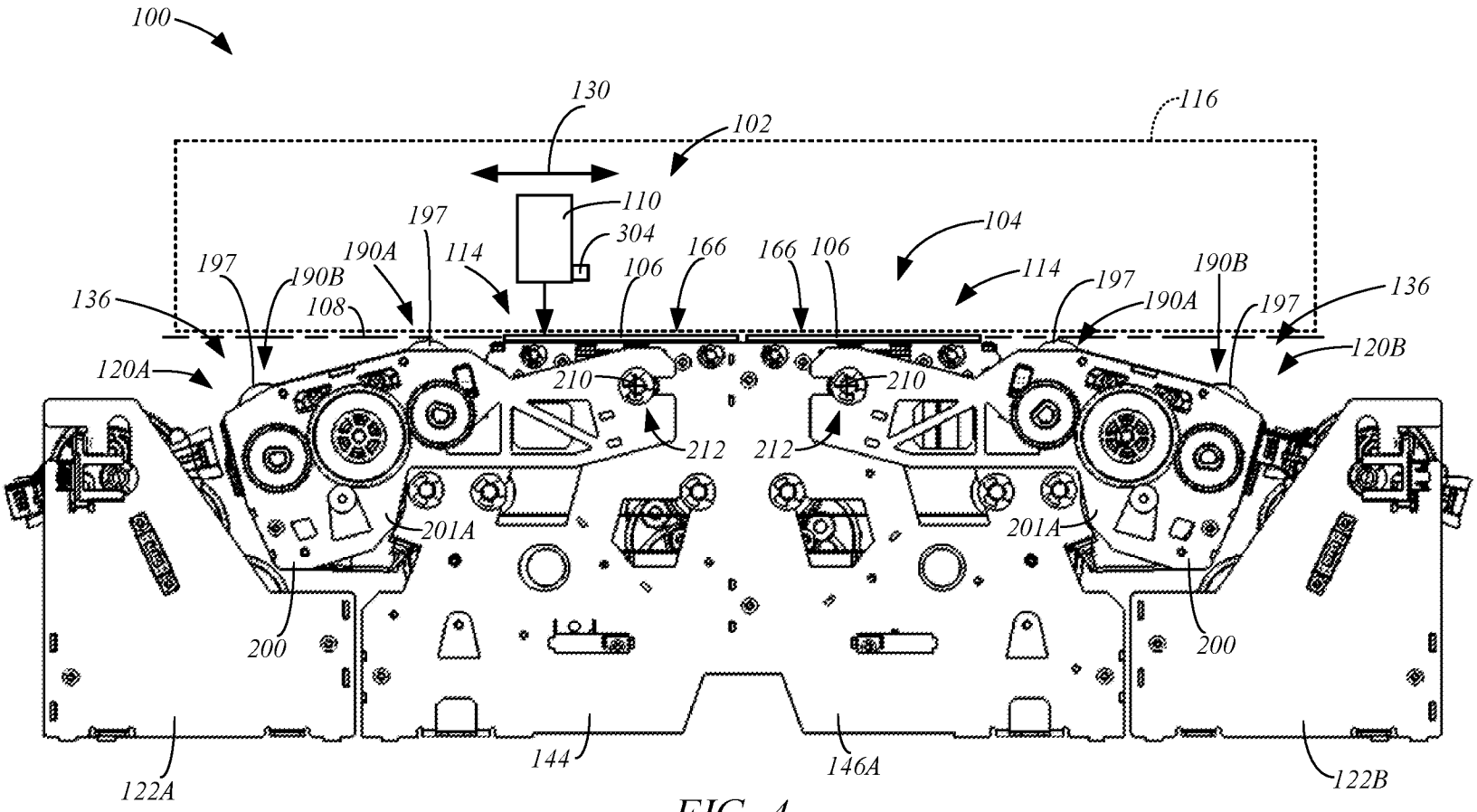
FIG. 4 is a side view of an exemplary ink jet card printer with the card feeders in their lowered positions, in accordance with embodiments of the present disclosure.
Figure 5:
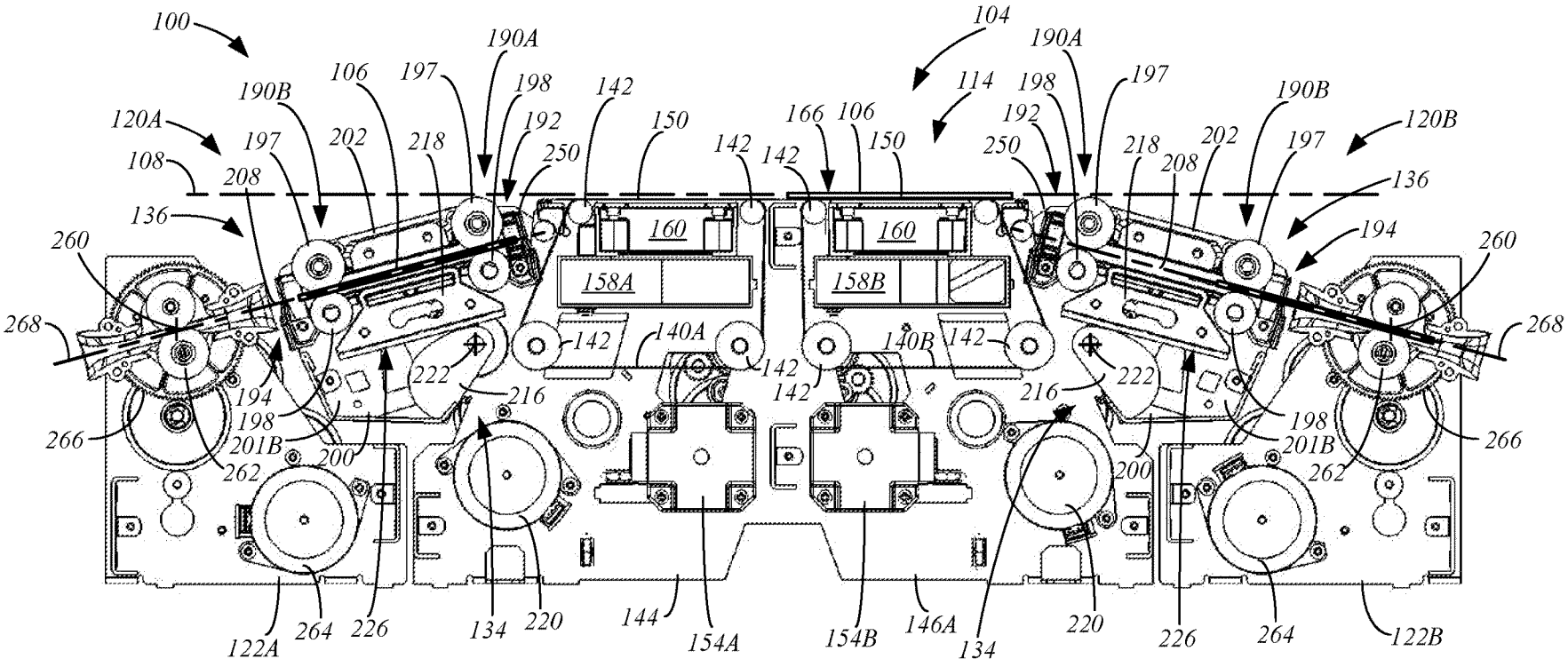
FIG. 5 is a side view of the printer of FIG. 4 with frame sidewalls removed, in accordance with embodiments of the present disclosure.

In some embodiments, the card feeders 120 each include a lift mechanism 134 to move the card feeders 120 to a lowered position 136, in which the card feeders 120 are displaced from the print zone 116, such as below the print zone 116, as indicated by card feeder 120A in FIG. 1, and the card feeders 120A and 120B in FIGS. 3-5. FIG. 3 is an isometric view of exemplary card transport 104 and card feeders 120 in their lowered positions 136, FIG. 4 is a side view of an exemplary printer 100 with the card feeders 120 in their lowered positions 136, and FIG. 5 is a side view of the printer 100 of FIG. 4 with frame side walls removed, in accordance with embodiments of the present disclosure.

Figure 6:
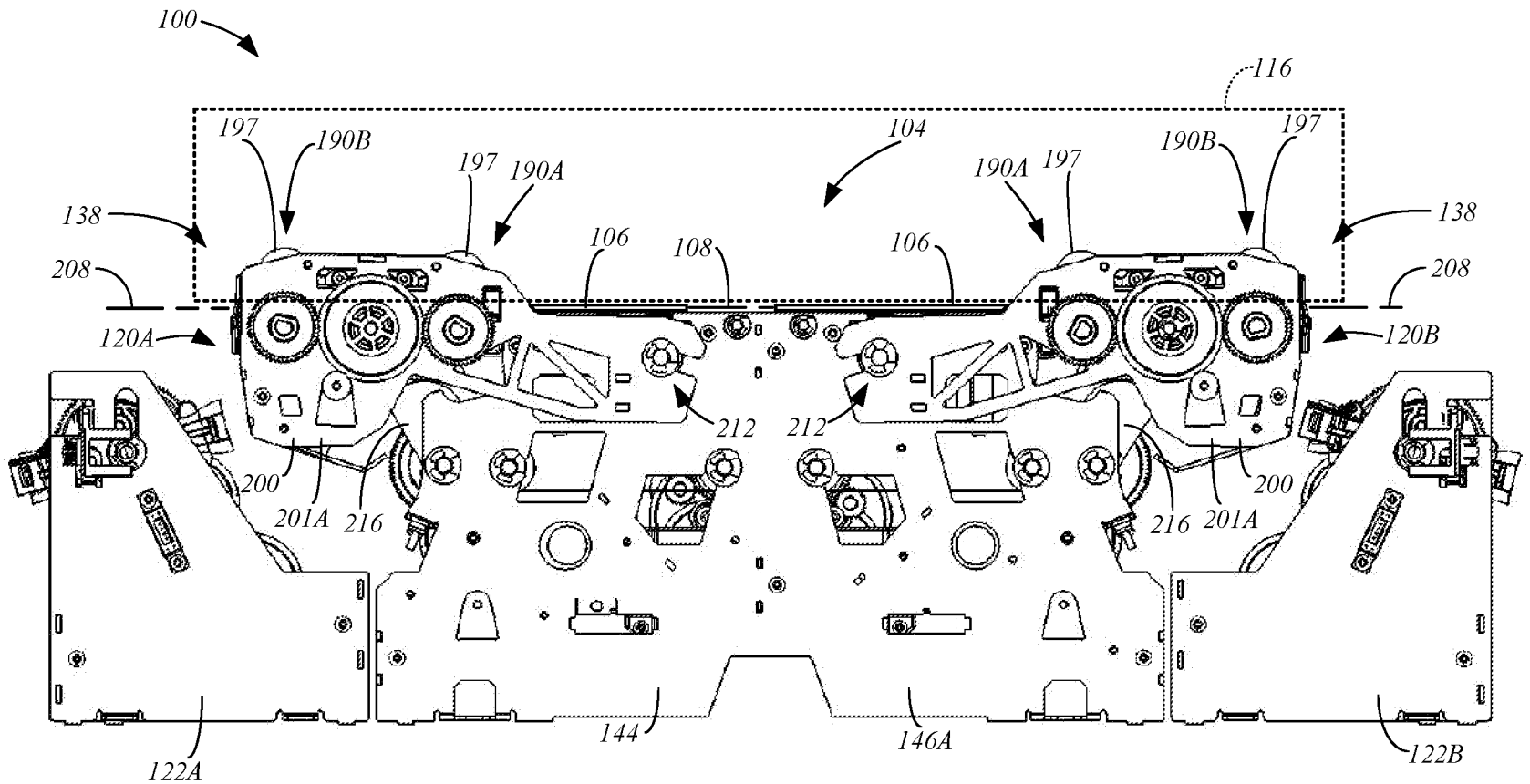
FIG. 6 is a side view of the printer of FIG. 4 with the card feeders in their raised positions, in accordance with embodiments of the present disclosure.
Figure 7:
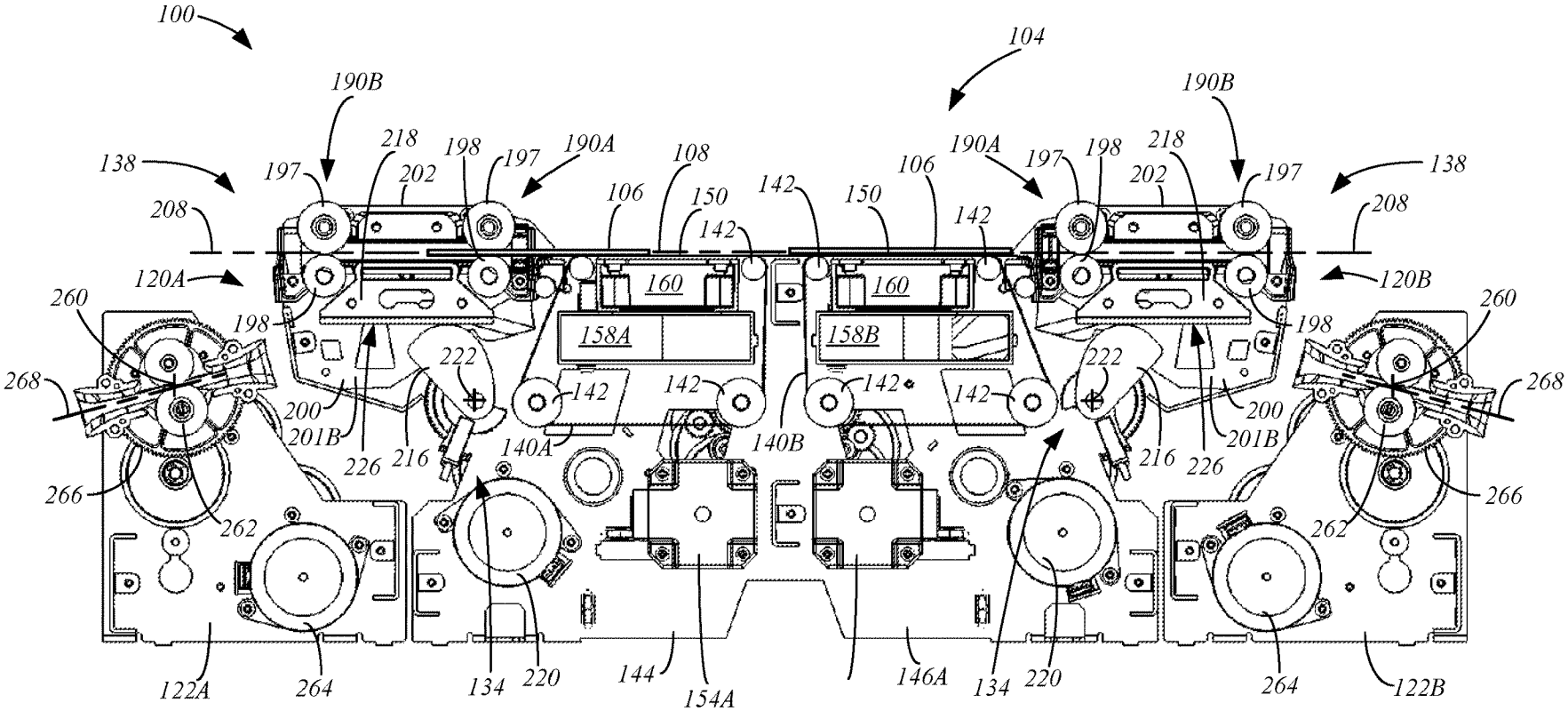
FIG. 7 is a side view of the printer of FIG. 6 with frame sidewalls removed, in accordance with embodiments of the present disclosure.

The lift mechanisms 134 may also move the card feeders 120 to a raised position 138, in which at least a portion of the card feeders 120 extend into the print zone 116, and the card feeders 120 are positioned to feed cards 106 to, or receive cards 106 from, the card transport 104, as indicated by the card feeder 120B in FIG. 1 and the card feeders 120A and 120B in FIGS. 6 and 7. FIG. 6 is a side view of the exemplary printer 100 of FIG. 4 with the card feeders 120 in their raised positions, and FIG. 7 is a side view of the printer 100 of FIG. 6 with frame side walls removed, in accordance with embodiments of the present disclosure. Thus, the card feeders 120 may be moved to their raised positions 138 by the lift mechanisms 134 to facilitate feeding cards 106 to, or receiving cards 106 from the card transport 104.

Thus, the lift mechanisms 134 may be used to move the card feeders 120 from their raised positions 138, in which at least a portion of the card feeders 120 would obstruct a printing operation, to their lowered positions 136, in which the card feeders 120 do not obstruct the print zone 116, to enable the print head 110 to be moved through the print zone 116 by the gantry 112 and perform a printing operation.

In some embodiments, the card transport 104 includes belts 140, such as first and second belts 140A and 140B (i.e., belt feeders or conveyors), that are each supported by rollers 142 for movement along a belt path. In one example, the first and second belts 140A and 140B are each supported by four rollers 142, which are supported by a belt frame 144, such as side walls 146A and 146B of the belt frame 144 (FIG. 3). The belts 140 include exposed portions 150 (i.e., top surfaces) adjacent the processing axis 108. The exposed portion 150 of each of the belts 140 contacts the cards 106 and is used to feed the cards 106 along the processing axis 108. Additionally, the cards 106 are supported on the exposed portions 150 in the print positions 114.

Motors 154A and 154B are respectively configured to independently drive the first and second belts 140A and 140B along their belt paths. Thus, the exposed portion 150 of the first belt 140A may independently feed a card 106 along the processing axis 108 in a direction toward the second belt 140B or in a direction toward the card feeder 120A using the motor 154A, and the exposed portion 150 of the second belt 140B may independently feed a card 106 along the processing axis 108 in the direction toward the first belt 140A, or in the direction toward the card feeder 120B using the motor 154B.

The belts 140 of the card transport 104 may take on any suitable form. In some embodiments, the belts 140 are conventional vacuum belts that are coupled to a vacuum source 158 (i.e., a source of negative pressure), such as a regenerative vacuum blower. The vacuum source 158 may be shared by the belts 140, as shown in FIG. 1, or separate vacuum sources 158A and 158B may respectively be used by the belts 140A and 140B, as shown in FIG. 5. Chambers 160 couple the negative pressure generated by the vacuum source 158 to the exposed portions 150 of the belts 140. The negative pressure is communicated to a top side of the exposed portions 150 through apertures 162 in the belts, which are shown in FIGS. 2 and 3, and is used to secure cards 106 to the exposed portions 150 during card feeding and printing operations. Thus, when a card 106 engages the top surface of the exposed portion 150 of one of the belts 140, the negative pressure generated by the vacuum source 158 or sources 158A and 158B adheres the card 106 to the belt 140. When the belts 140 are driven by the corresponding motor 154, the adhered card 106 is driven along the processing axis 108.

During a printing operation, with the card feeders 120 in their lowered positions 136, each of the belts 140 may feed a card 106 along the processing axis 108 to the corresponding print position 114, in which the exposed top surfaces 166 of the cards 106 are at the border of the print zone 116, as shown in FIGS. 1, 2, 4 and 5. The print head 110 may perform a print operation on the top surfaces 166 of the cards 106 supported in the print positions 114. Thus, the print head 110 may print an image to the exposed surface 166 of the card 106 supported in the print position 114 on the belt 140A, print an image to the surface 166 of the card 106 supported in the print position 114 on the belt 140B, and/or simultaneously print images to the surfaces 166 of both cards 106 supported in the print positions 114 on the belts 140A and 140B during a single printing operation.

For example, referring to FIG. 2, with the card feeders 120 in their lowered positions 136, and the cards 106 held in the print positions 114 against the exposed portions 150 of the belts 140A and 140B due to the negative pressure generated by the vacuum source 158 or sources 158A and 158B (FIGS. 1, 2, 4 and 5), the gantry 112 may move the print head 110 along the fast scan axis 130 (processing axis 108) over the cards 106, while the print head 110 prints image lines to the surfaces 166, as indicted by arrow 170. After the print head 110 is moved past the end of the card 106 adjacent the card feeder 120B, the gantry 112 shifts the print head 110 along the slow scan axis 132, as indicated by arrow 172. The gantry 112 then moves the print head 110 back along the fast scan axis 130 (arrow 174), during which the print head 110 prints image lines to the surfaces 166 of the cards 106. The gantry 112 again shifts the position of the print head 110 along the slow scan axis 132 (arrow 176), and the print head 110 prints image lines as the gantry 112 moves the print head 110 along the fast scan axis 130 (arrow 178). These steps of printing image lines while moving the print head 110 along the fast scan axis 130 and shifting the position of the print head 110 along the slow scan axis 132, are repeated until the images have been printed to the surfaces 166 of the cards 106. Accordingly, a single print operation may simultaneously print images to two cards 106 supported on the belts 140.

To print a full edge-to-edge image on a card 106, the print head 110 may be configured to print an image that is slightly larger than the surface 166 of the card 106. As a result, some ink will overspray the edges of the card 106.

In some embodiments, the exposed surface 150 of each belt 140 has a smaller surface area than the card 106. That is, the width and length of the exposed belt surfaces 150 are selected such that they are less than the corresponding width and length of the cards 106, as generally shown in FIG. 2 with the cards 106 shown in phantom lines. Thus, when a card 106 is in the print position 114, the entirety of the exposed belt surface 150 is covered by the card 106, and a perimeter portion 180 of the card 160 extends beyond the edges of the exposed belt surface 150. This allows the print head 110 to print images that extend to the edges of the surfaces 166 of cards 106 while protecting the exposed belt surface 150 from ink contamination.

In some embodiments, the printer 100 includes an ink overspray collector 182 that surrounds a perimeter of the exposed belt surface 150 and extends beyond the edges of the cards 106 when in their print positions 114, as shown in FIG. 2. Thus, the collector 182 is positioned to receive ink that is sprayed over the lengthwise and widthwise edges of the cards 106 during a printing operation. In some embodiments, the ink overspray collector 182 is a disposable component that may be periodically removed and replaced by an operator of the printer 100. The collector 182 may be formed of plastic, paper, cardboard, or another suitable material. In some embodiments, the collector 182 is a single piece of material having an opening 184A for the exposed belt surface 150 of the belt 140A, and an opening 184B for the exposed belt surface 150 of the belt 140B.

As mentioned above, the card feeders 120 are each configured to deliver cards 106 to, and receive cards 106 from the card transport 104 when in their raised positions 138 (FIGS. 6 and 7). The card feeders 120 may also receive cards 106 for processing from the card supply 124, such as using card feeder 120A, and discharge processed cards 106 to the collector 126, such as using the card feeder 120B, as indicated in FIG. 1.

In some embodiments, the card feeders 120 each include at least one pinch roller pair 190, such as pinch roller pairs 190A and 190B, as shown in FIGS. 1, 5 and 7. In some embodiments, at least a portion of one or both of the pinch roller pairs 200 extends into the print zone 116 when the card feeder 120 is in the raised position 138, as shown in FIG. 7. The pinch roller pairs 190A and 190B are respectively positioned adjacent ports 192 and 194 of the card feeder 120, with the port 192 being positioned adjacent an input/output end 196 of the corresponding belt 140, as shown in FIG. 3. Each pinch roller pair 190 may include an idler roller 197 and a motorized feed roller 198 (FIGS. 5 and 7) that are supported by a card feeder frame 200, such as between side walls 201A and 201B of the frame 200, as shown in FIG. 3. While the idler roller 197 is illustrated as being the top roller in the provided examples, it is understood that the positions of the rollers 197 and 198 may be reversed. A cover 202 may be positioned between the pinch roller pairs 190A and 190B to cover a portion of the path through which cards 106 are fed through the card feeder 120, as shown in FIG. 3.

The card feeders 120A and 120B respectively include motors 204A and 204B (FIG. 1) for driving the motorized rollers 198 to feed a card 106 supported between one or both of the pinch roller pairs 190A and 190B along a card feed axis 208. The separate motors 204 of the feeders 120 allow the controller 118 to independently control the card feeders 120. As a result, the card feeder 120A may be used to deliver a card 106 to the belt 140A while the card feeder 120B delivers a card 106 to the collector 126, for example.

The card feed axis 208 of each feeder 120 is substantially parallel to a vertical plane extending through the processing axis 108. Thus, as shown in the top view of FIG. 2, the card feed axes 208 of the feeders 120 are oriented substantially parallel (e.g., ±5 degrees) to the processing axis 108 within a horizontal plane.

In some embodiments, the lift mechanisms 134 pivot the frame 200 of the card feeders 120 about a pivot axis 210 (FIG. 3) during movement of the card feeders 120 between their raised and lowered positions 138 and 136. As a result, the orientation of the card feed axis 208 relative to the processing axis 108 in a vertical plane changes with movement of the card feeders 120 between their raised and lowered positions 138 and 136. When the card feeder 120 is in its lowered position 136, the card feed axis 208 is at an oblique angle (e.g., 20-50 degrees) to the processing axis 108 in the vertical plane, as shown in FIG. 5. When the card feeder 120 is in its raised position, the card feed axis 208 is substantially parallel to the processing axis 108 in the vertical plane, as shown in FIG. 7, allowing the card feeder 120 to deliver a card 106 to the adjacent belt 140, or receive a card 106 from the adjacent belt 140 using one or more of the pinch roller pairs 190.

In some embodiments, the pivot axis 210 is defined by a pivotable connection 212 between the card feeder frame 200 and the belt frame 144, as indicated in FIG. 3. In one embodiment, the pivotable connection or hinge 212 is formed between the side walls 201A and 201B of the card feeder frame 200 and the corresponding side walls 146A and 146B of the belt frame 144.

In one exemplary embodiment, each lift mechanism 134 includes a cam 216, a cam follower 218 and a motor 220, as shown in FIGS. 5 and 7. The separate motors 220 allow the controller 118 to independently control each lift mechanism 134. In one example, each cam 216 is supported by the belt frame 144 for rotation about an axis 222 (FIG. 3), and each cam follower 218 is supported by the card feeder frame 200 and pivots with the card feeder frame 200 about the pivot axis 210. Alternatively, the positions of the cam 216 and the cam follower 218 may be reversed where the cam 216 is supported by the belt frame 144 and the cam follower 218 is supported by the card feeder frame 200. In some embodiments, the cam follower 218 is biased to engage the cam 216 using a suitable biasing mechanism, such as a spring.

During an exemplary lift operation, in which the card feeder 120 is moved from the lowered position 136 (FIG. 5) to the raised position 138 (FIG. 7), the controller 118 activates the motor 220 of the lift mechanism 134 to drive rotation of the cam 216 about the axis 222 in the direction indicated by arrow 224 in FIG. 3. As the cam 216 rotates, it slides and presses against a cam surface 226 (FIG. 5) of the cam follower 218. This drives the card feeder frame 120 to pivot about the pivot axis 210 until the card feeder 120 reaches the raised position 138 shown in FIG. 7. The operation is reversed to move the card feeder 120 back to its lowered position 136. That is, the controller activates the motor 220 of the lift mechanism 134 to drive rotation of the cam 216 about the axis 222 in the direction opposite arrow 224 (FIG. 3). During this rotation of the cam 216, the cam surface 226 of the cam follower 218 slides along the cam 216 and the card feeder frame 200 pivots about the pivot axis 210 until the card feeder 120 reaches the lowered position 136 shown in FIG. 5.

Alternative lift mechanisms 134 may also be employed. For example, different lift mechanisms may be used to pivot the card feeders 120 between their raised and lowered positions 138 and 136, such as a screw drive, or another suitable lift mechanism. Additionally, the lift mechanisms 134 may be configured to move the card feeders 120 linearly between the raised and lowered positions 138 and 136.

Figure 8:
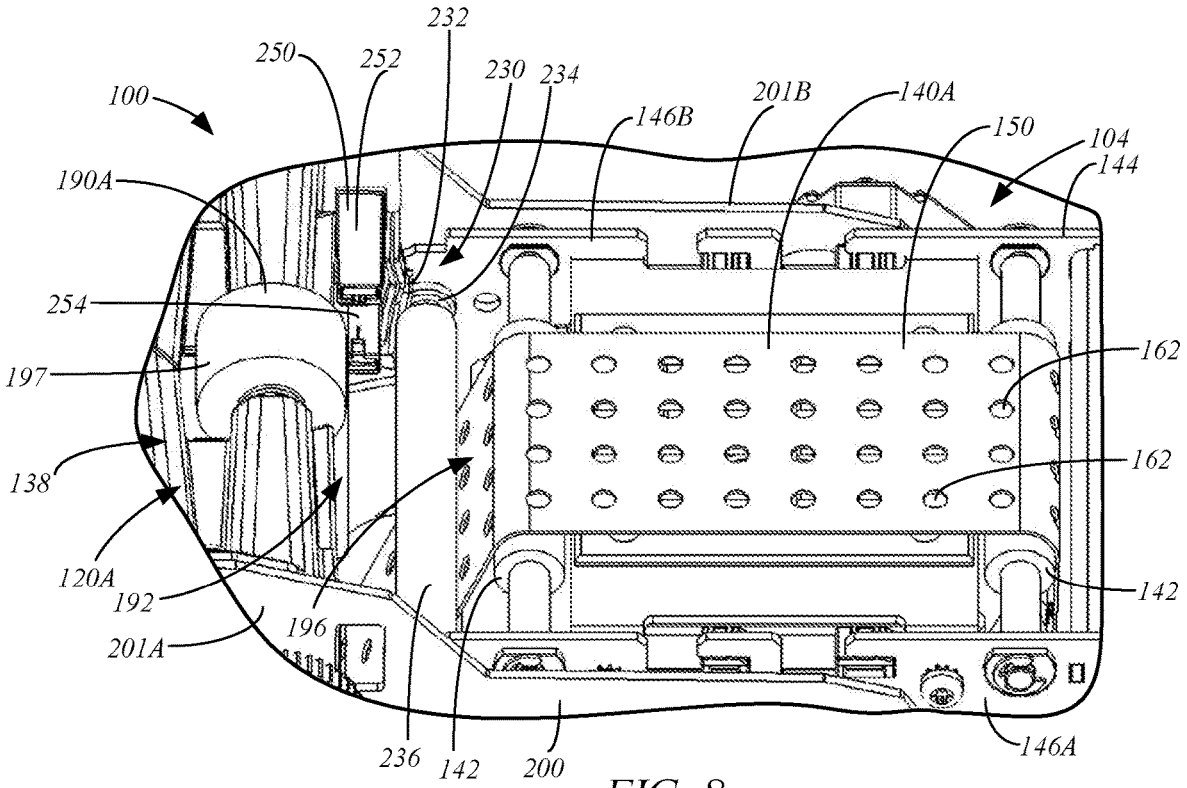
FIGS. 8 and 9 are front and top isometric views of a portion of an ink jet card printer at an interface between a card feeder and a belt, in accordance with embodiments of the present disclosure.
Figure 9:
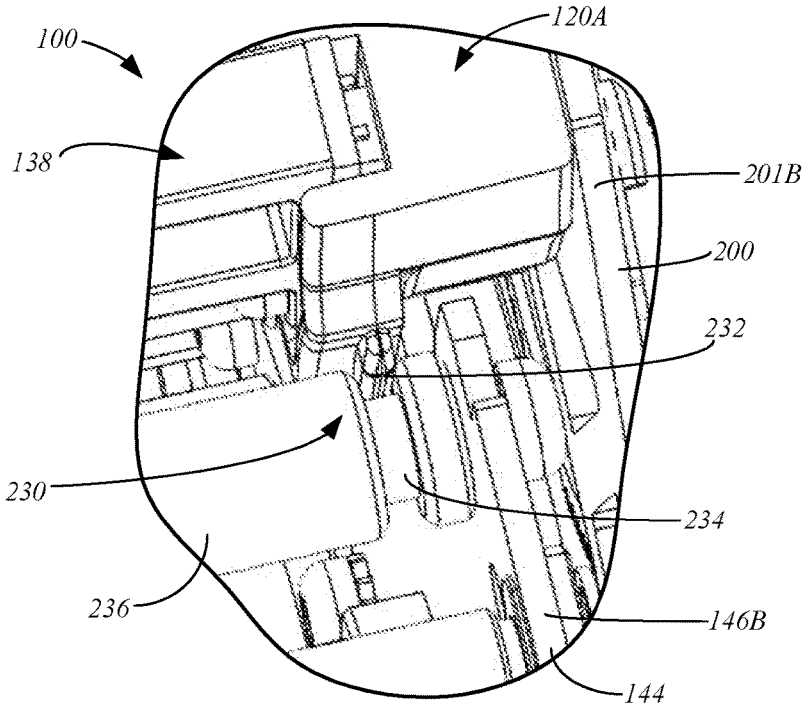

In some embodiments, a lateral stabilizer 230 is used in connection with each of the card feeders 120 to ensure substantial coaxial alignment in the horizontal plane between the card feed axis 208 and the processing axis 108 of the adjacent belt 140, as shown in FIG. 2, when the card feeders 120 are in their raised positions 138. One example of a suitable lateral stabilizer 230 is shown in FIGS. 8 and 9, which are front and top isometric views of a portion of the printer 100 at the interface between the card feeder 120A and the belt 140A with the ink collector 182 removed. In some embodiments, the lateral stabilizer 230 is positioned between the pinch roller pair 190A at the port 192 and the input/output end 196 of the adjacent belt 140A, as shown in FIG. 8.

In one embodiment, the lateral stabilizer 230 includes a first stabilizing member 232 connected to the card feeder frame 200, and a second stabilizing member 234 connected to the belt frame 144. Thus, the first stabilizing member 232 moves with movement of the card feeder frame 200 about the pivot axis 210 relative to the second stabilizing member 234. The first stabilizing member 232 engages with the second stabilizing member 234 in a cooperating manner when the card feeder 120 is moved from the lowered position 136 to the raised position 138 to provide the desired lateral alignment of the card feed axis 208 and the processing axis 108. In some embodiments, the first and second stabilizing members 232 and 234 are displaced from each other when the card feeder 120 is in the lowered position 136.

In one exemplary embodiment, the first stabilizing member 232 is in the form of a rib member and the second stabilizing member is in the form of a groove 234, as shown in FIGS. 8 and 9. Alternatively, the positions of the rib member and groove may be reversed. The groove 234 may be formed in a bar 236 extending between the side walls 146A and 146B of the belt frame 144. As the card feeder 120 is moved from the lowered position 136 to the raised position 138, the rib member 232 is received within the groove 234, as shown in FIG. 9, to align the card feed axis 208 with the processing axis 108 and maintain the alignment during card feeding operations between the card feeder 120A and the belt 140A.

Ideally, each card feeder 120 supports a received card 106 such that a central axis of the card 106 is aligned with the card feed axis 208. This ensures that the card 106 is fed to the adjacent belt 140 in alignment with the processing axis 108, which allows for accurate positioning of the card 106 in the print position 114 on the belt 140 and accurate printing of an image to the card surface 166.

Figure 10:
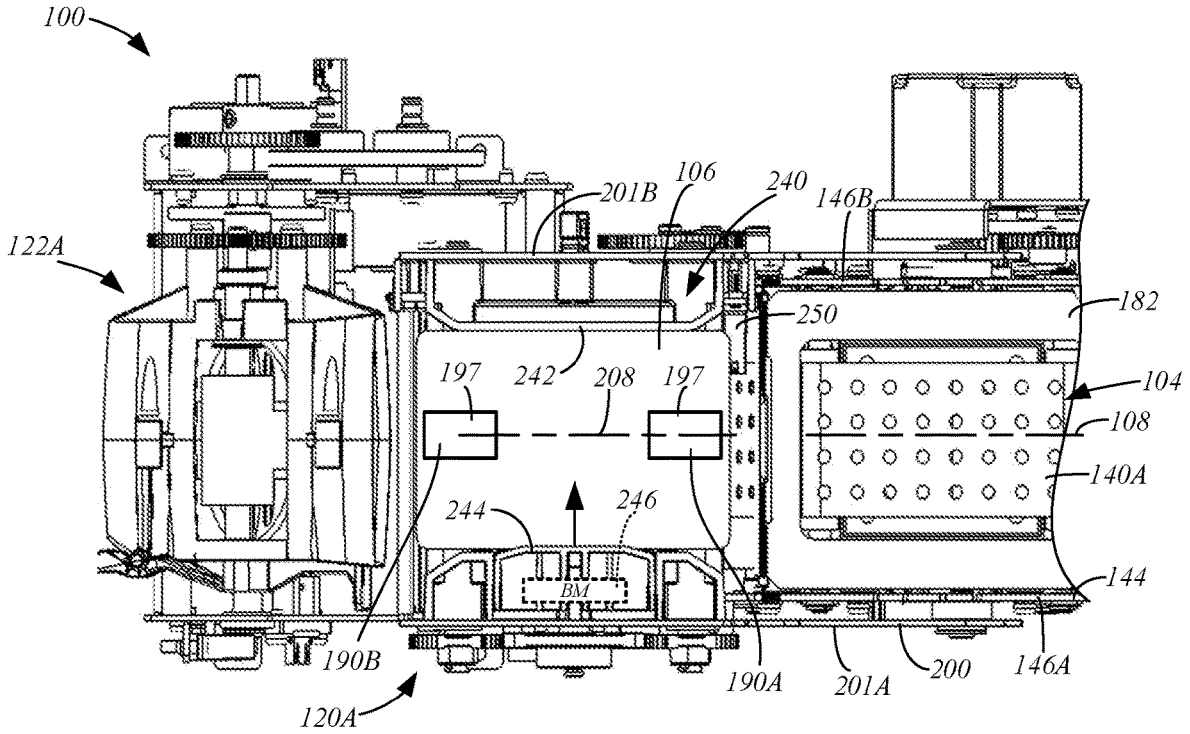
FIG. 10 is a top view of a portion of an ink jet card printer, in accordance with embodiments of the present disclosure.

In some embodiments, each card feeder 120 includes a card alignment mechanism 240, an example of which is illustrated in the top view of a portion of the printer 100 provided in FIG. 10 with the cover 202 removed. The card alignment mechanism 240 is configured to prevent misalignment between a card 106 supported by the one or more pinch roller pairs 190 of the card feeder 120 and the card feed axis 208. One embodiment of the card alignment mechanism 240 includes a reference wall 242, a pusher wall 244 and a biasing mechanism 246. The reference wall 242 is aligned parallel to the card feed axis 208 and has a fixed position relative to the card feeder frame 200. The pusher wall 244 is moveable relative to the card feeder frame 200 and the reference wall 242. The biasing mechanism 246 is configured to bias the pusher wall 244 toward the reference wall 242. Embodiments of the biasing mechanism 246 include a spring or another conventional biasing mechanism.

As a card 106 is received by the card feeder 120 with the central axis of the card 106 being offset from the card feed axis 208 or non-parallel to the card feed axis 208, the pusher wall 244 pushes the card 106 toward the reference wall 242 due to the bias produced by the biasing mechanism 246. This causes an edge of the card 106 to engage the reference wall 242. As the card 106 continues to be fed into the card feeder 120 by the pinch roller pairs 190, the edge of the card 106 engaging the reference wall 242 aligns with the reference wall 242 and aligns the central axis of the card 106 with the card feed axis 208.

The printer 100 may include one or more sensors 250 to facilitate various card feeding operations, such as receiving a card 106 in the card feeders 120 and positioning a card 106 in the print position 114 on the belts 140. In one embodiment, the printer 100 includes a card sensor 250 for detecting the presence or absence of a card at each side of the card transport 104, as indicated in FIG. 1. In some embodiments, the card sensors 250 are positioned between the pinch roller pair 190A and the adjacent belt 140. In some embodiments, the card sensors 250 are supported by the card feeder frame 200, as shown in FIGS. 3 and 8. The card sensors may take on any suitable form, such as an optical card sensor having an emitter 252 and a receiver 254, as shown in FIG. 8.

During reception of a card 106 by a card feeder 120 in its lowered position 136, the sensor 250 may be used to detect the leading edge of the card 106 being fed toward the card transport belt 140, which may indicate that the card 106 is fully received in the card feeder 120. The card feeder 120 may then be moved from the lowered position 136 to the raised position 138. After the card feeder 120 is moved to the raised position 138, the corresponding card sensor 250 may be used to detect the trailing edge of the card 106 as the card is fed to the adjacent belt 140. The controller 118 may use this detection of the trailing edge of the card 106 to control the belt 140 to position the card 106 in the desired print position 114.

The card sensors 250 may also be used by the controller 118 to control the reception of cards 106 fed from the belts 140 by the card feeders 120. For example, as a card 106 is fed from the belt 140 toward the card feeder 120, the card sensor 250 may detect the leading edge of the card 106. This detection may be used by the controller 118 to control the pinch roller pairs 190 to receive the card 106 in the card feeder 120. The card 106 may then be fed into the card feeder 120 using the pinch roller pairs 190 until the sensor 250 detects the trailing edge of the card 106 indicating that the card 106 has been fully received within the card feeder 120 and that the card feeder 120 is ready to be moved to its lowered position 136.

As mentioned above, the printer may optionally include one or more card flippers 122 that may be used to invert cards 106 to facilitate printing operations on both sides of the cards 106. Each card flipper 122 may be configured to receive a card 106 from the adjacent card feeder 120, the card supply (flipper 122A) or the card collector (flipper 122B), rotate the card 106 about a flipping axis 260 to invert the card 106, and pass the inverted card 106 back to the adjacent card feeder 120, which can deliver the inverted card 106 to the card transport 104 and the print unit 102 for a printing operation. The card flippers 122 may each be conventional card flippers. One suitable card flipper 122 which may be used by the printer is described in U.S. Pat. No. 7,878,505, which issued to HID Global Corporation and is incorporated herein by reference in its entirety.

In some embodiments, each flipper 122 includes a pinch roller pair 262 that is configured to hold the card 106 during rotation about the flipping axis 260. One or more motors 264 (FIGS. 1 and 5) are used to drive rotation of a gear 266, that supports the pinch roller pair 262 and a card 106 supported by the pinch roller pair, about the flipping axis 260. In some embodiments, the card feed axis 268 of each flipper 122 is configured to rotate into alignment with the card feed axis 208 of the adjacent card feeder 120 when it is in the lowered position 136. The motor 264 may also drive the pinch roller pair 262 to feed a card 106 supported by the pinch roller pair 262 to the pinch roller pair 190B at the port 194 of the adjacent card feeder 120, such as shown in FIG. 5. The adjacent card feeder 120 may then move to the raised position 138 and feed the card 106 to the adjacent belt 140, as shown in FIG. 7.

Some embodiments of the present disclosure are directed to methods of printing an image to one or more cards 106 using the ink jet card printer 100. In one embodiment of the method, a card 106, which may have been received from the supply 124 and fed to the card feeder 120A by the card flipper 122A, is supported by the pinch roller pairs 190 of the card feeder 120A while in its lowered position 136, as shown in FIG. 5. The card feeder 120A is moved to its raised position 138 using the corresponding lift mechanism 134, and the card 106 is discharged from the card feeder 120A to the belt 140A using the pinch roller pair 190A. The card feeder 120A is then moved to the lowered position 136 (FIGS. 4 and 5) and out of the print zone 116 using the lift mechanism 134, and the card 106 is fed along the processing axis 108 by the belt 140A to the print position 114 (FIG. 2). An image is then printed to the surface 166 of the card 106 using the print head 110, which involves moving the print head 110 with the gantry 112 through the print zone 116, as indicated in FIGS. 1 and 2.

Figure 11:
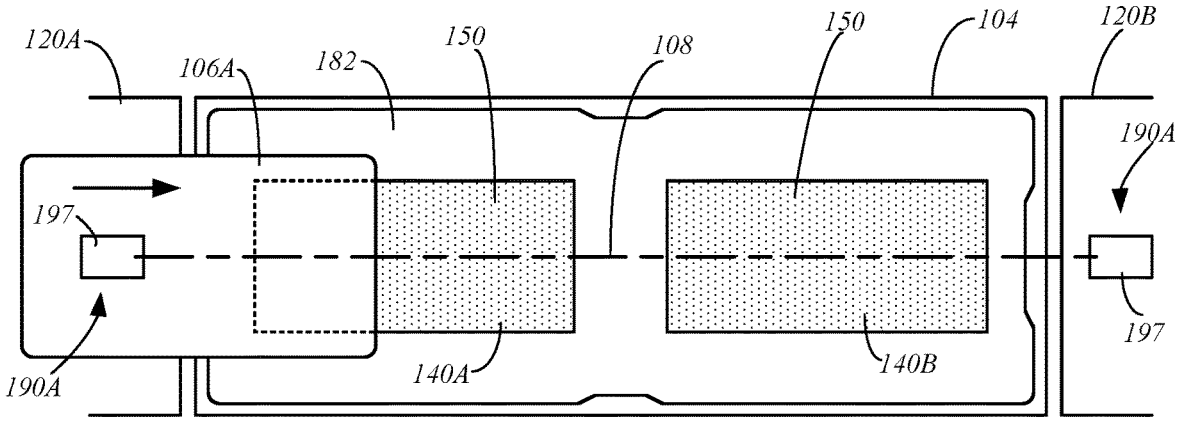
FIGS. 11-16 are simplified top views of a card transport and card feeders during various stages of a printing operation, in accordance with embodiments of the present disclosure.
Figure 12:
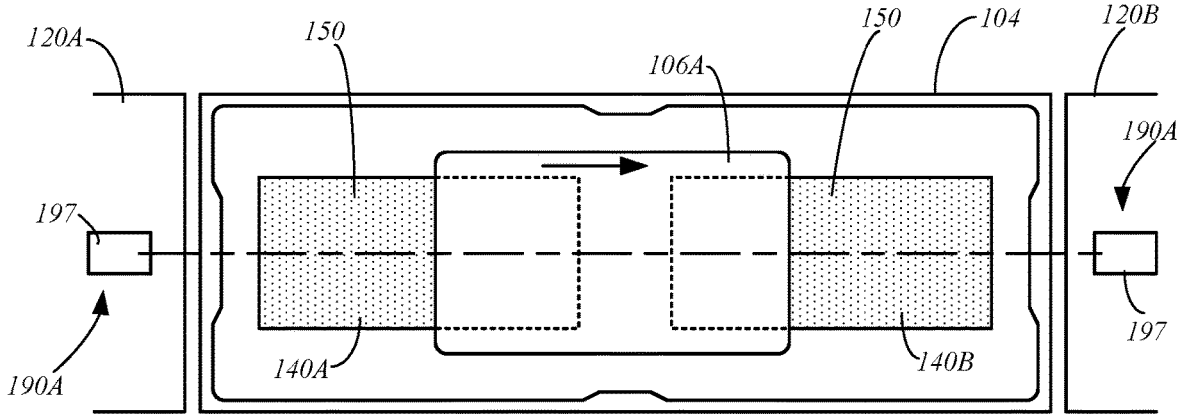
Figure 13:
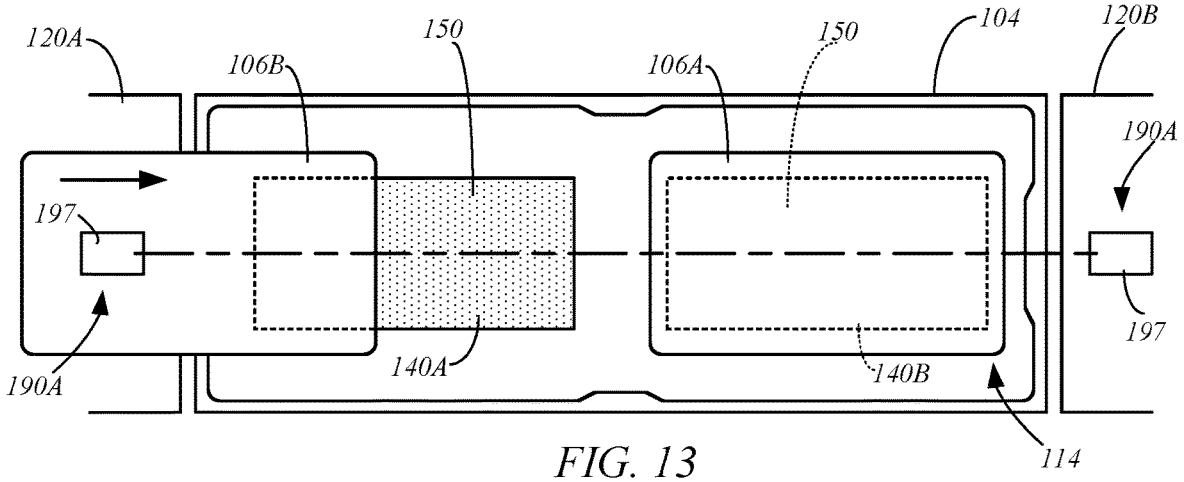
Figure 14:
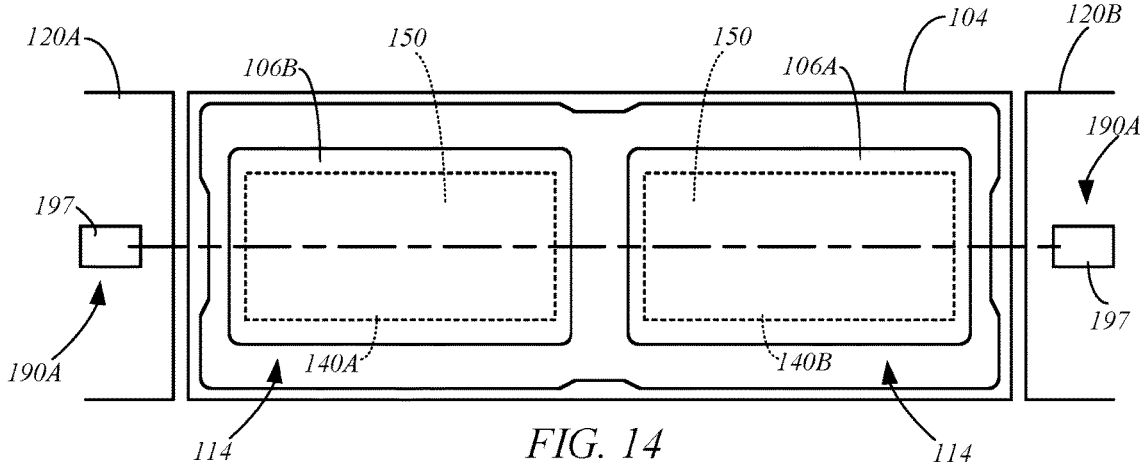

Some embodiments of the method involve performing a print operation using the ink jet card printer 100 to print images on two cards 106 simultaneously. One example of such a method will be described with reference to FIGS. 11-16, which are simplified top views of the card transport 104 and the card feeders 120A and 120B during various stages of the method. Initially, a pair of cards 106 may be fed from the supply 124 to the card transport 104 with the card feeders 120 in their lowered positions 136. This may involve feeding a first card 106 from the supply 124 through the card flipper 122 to the card feeder 120A, as shown in FIGS. 1 and 5. The card feeder 120A may then be moved to its raised position 138 using the lift mechanism 134, and the first card 106A is fed to the belt 140A by the pinch roller pair 190A, as shown in FIG. 11. The card feeder 120A may then return to its lowered position 136, and a second card 106 may be fed from the supply 124 through the flipper 122A to the card feeder 120A in the same manner as the first card. During the feeding of the second card 106A to the card feeder 120A, the first card 106A may be fed by the belt 140A to the belt 140B, during which the card 106A is simultaneously supported by both belts 140A and 140B, as shown in FIG. 12. The card 106A may then be moved by the belt 140B to the print position 114, as shown in FIG. 13. The second card 106B is fed to the belt 140A using the pinch roller pair 190A of the card feeder 120A, as indicated in FIG. 13, and the second card 106B is moved along the processing axis 108 by the belt 140A to its print position 114, as shown in FIG. 14. The card feeder 120A is then moved to its lowered position 136.

With the cards 106A and 106B supported in their print positions 114 on the belts 140B and 140A, and the card feeders 120A and 120B in their lowered positions 136 (FIG. 5), a printing operation is simultaneously performed on the first and second cards 106A and 106B using the print unit 102, as discussed above with reference to FIG. 2. This printing operation involves moving the ink jet print head 110 in the fast scan direction 130 across the cards 106 and moving the ink jet print head 110 in a slow scan axis 132 that is perpendicular to the fast scan axis 134 through the print zone 116 using the gantry 112. The cards 106 are imaged by the ink jet print head (i.e., active printing phase) while the print head 110 is moved in the fast scan direction 130 by the gantry 112.

Figure 15:
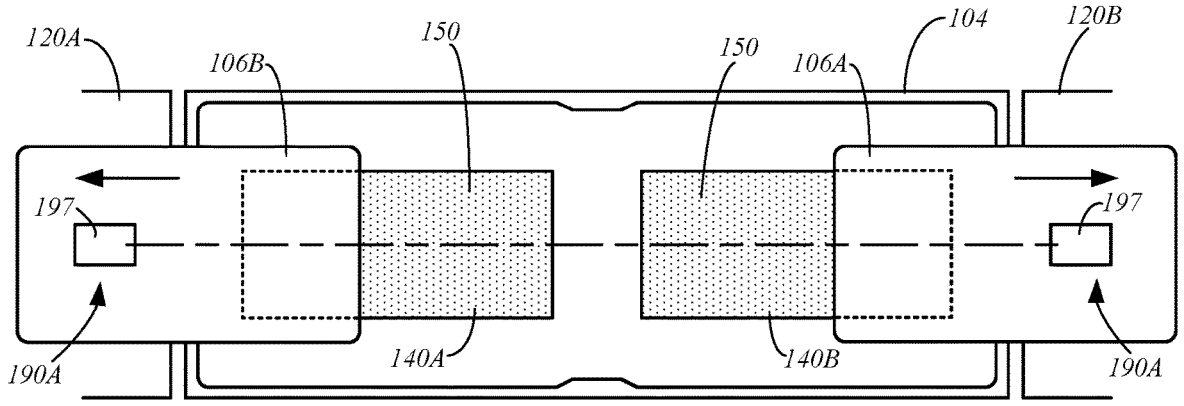
Figure 16:
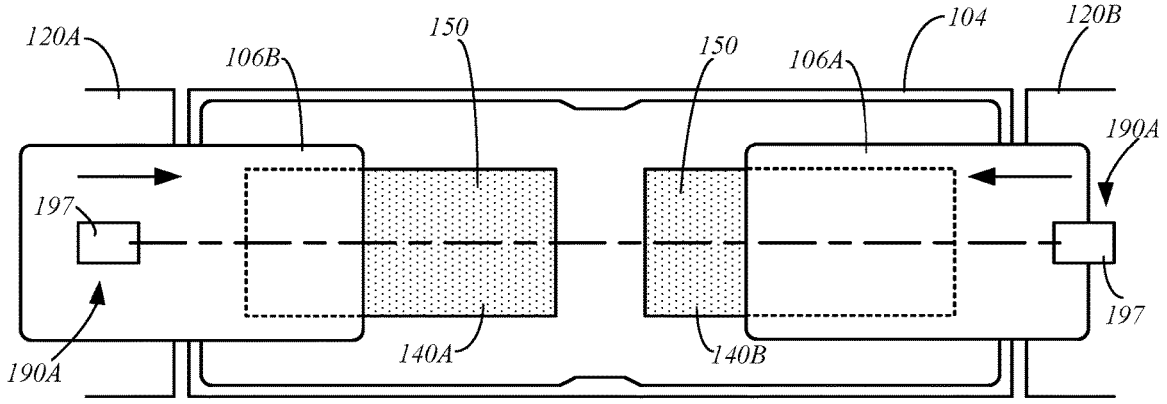

After the images have been printed to the cards 106A and 106B, the card feeders 120A and 120B are returned to their raised positions 138 by the lift mechanisms 134, and the cards 106A and 106B are delivered to the adjacent card feeders 120A and 120B using the belts 140A and 140B, as indicated in FIG. 14. After receiving the cards 106A and 106B, the card feeders 120A and 120B are moved to their lowered positions 136 by the lift mechanisms 134, and the cards 106A and 106B are fed to the corresponding flippers 122A and 122B, such as generally shown in FIG. 5. The flippers 122A and 122B invert the cards 106A and 106B and feed the inverted cards back to the card feeders 120A and 120B, which are then returned to their raised positions 138. The cards 106A and 106B are then fed back to the adjacent belts 140A and 140B by the card feeders 120A and 120B, as indicated in FIG. 15. The belts 140A and 140B then move the cards 106B and 106A to the print positions 114 (FIG. 13) and the card feeders 120A and 120B are again moved to their lowered positions 136. The print head 110 then prints images to the non-imaged surfaces 166 of the cards 106A and 106B as discussed above with reference to FIG. 2.

With images printed to both sides of the cards 106A and 106B, the cards may be discharged to the collector 126 using the card feeder 120B. The card feeder 120B is first moved to the raised position 138, and the belt 140B feeds the card 106A to the card feeder 120B. The card feeder 120B is then moved to its lowered position 136, and the card 106A is fed to the collector 126 through the flipper 122B (FIG. 5). The card 106B is fed from the belt 140A to the belt 140B and the card feeder 120B is returned to the raised position 138. The card feeder 120B then receives the card 106B from the belt 140B, and is moved to its lowered position 136 by the corresponding lift mechanism 134. The card 106B can then be discharged from the card feeder 120B to the collector 126 through the flipper 122B.

Some embodiments of the present disclosure operate to ensure that at least one card 106 is properly registered with a print position 114 and an active print zone of the belt 140A or 140B prior to commencing a print operation. In some embodiments, when a card 106 is in the print position 114 for a given belt 140, the card 106 is in position to receive an image printed using the ink jet print head 110. Additionally, in some embodiments, when a card 106 is in the print position 114 for a given belt 140, the card 106 entirely covers the exposed surface 150 of the belt that engages the card 106 to prevent ink contamination of the belt 140 during a printing operation on the card 106. Embodiments of the present disclosure operate to ensure that the cards 106 are in the proper print positions 114 (FIG. 14) before printing images to the cards 106 with the print head 110.

The print positions 114 for the cards 106 on the belts 140 generally correspond to active print zones of the ink jet print head 110, in which the print head 110 is configured to print images during a print operation. Thus, the gantry 112 will move the print head 110 along the fast and slow scan axes 130 and 132, as discussed above with reference to FIG. 2, and the print head 110 will discharge ink to the corresponding active print zone to form an image on a card 106 that is positioned within the active print zone. Since ink is not discharged by the print head 110 outside the active print zone during a print operation, edge-to-edge printing of an image to the surface 166 of a card 106 requires the entire surface 166 to be positioned within the active print zone. Embodiments of the present disclosure operate to ensure that cards 106 are positioned within an active print zone before performing a print operation. Additionally, embodiments of the present disclosure operate to compensate or correct for misregistration of the cards 106 with the active print zones to enable a printing operation to be performed.

Figure 17:
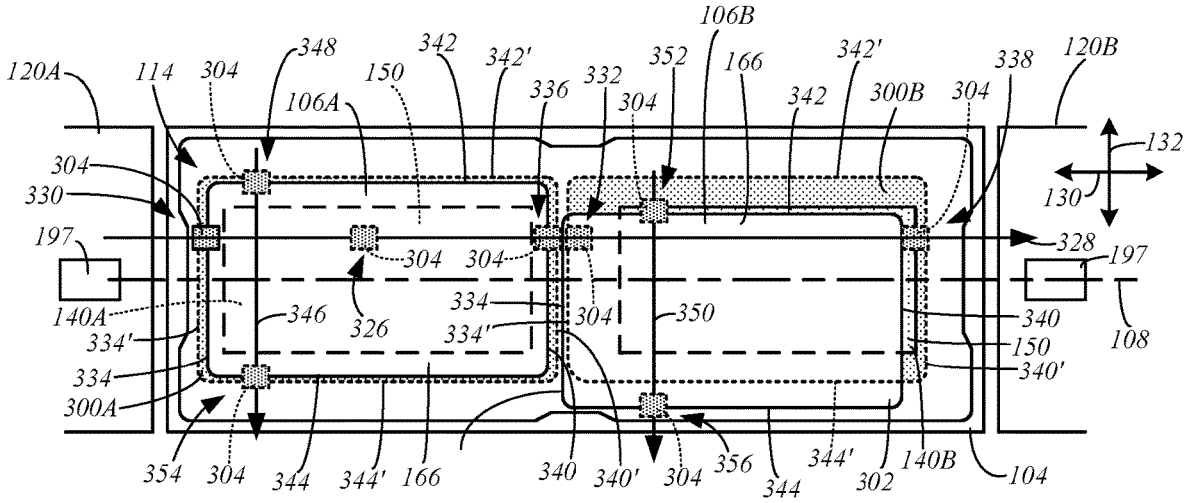
FIG. 17 is a top plan view of a card transport illustrating embodiments of the present disclosure.

FIG. 17 is a simplified top plan view of the card transport 104 and illustrates a card 106A that is in proper registration with the print position 114 of the belt 140A and the corresponding active print zone 300A. As a result, the print head 110 should accurately print an image to the surface 166 of the card 106A during a print operation without contaminating the belt 140A with ink.

FIG. 17 also illustrates a card 106B that is misregistered with the print position 114 of the belt 140B and the active print zone 300B. If a print operation were to be performed on the misregistered card 106B, the portion 302 of the card 106B extending outside the active print zone 300B would not receive the printed image. As a result, if a printing operation were to be performed, the image printed to the card 106B would not extend over the entire surface 166 (edge-to-edge image). Additionally, since the exposed surface 150 of the belt 140B is not entirely covered by the card 106B, the uncovered portion of the surface 150 will receive a portion of the printed image, thus contaminating the belt 140B with ink.

In some embodiments, the printer 100 includes a sensor 304 (FIGS. 1 and 2) that may be used by the controller 118 to determine whether cards 106 are properly positioned in their print positions 114 and within the active print zones 300 on the belts 140A or 140B prior to performing a print operation on the cards 106 using the print head 110. In some embodiments, the sensor 304 is supported by the gantry 112 for movement with the print head 110 along the fast axis 130 and the slow axis 132. The sensor 304 may be attached to a carriage 305 (FIG. 1) that supports the print head 110 for movement by the gantry 112.

A suitable coordinate system is used to establish a location of the sensor 304 relative to features of the card transport 104, such as the belts 140, for example. In one example, the coordinate system may include one axis that is aligned with the processing axis 108 and the fast scan axis 130, and a second axis that is aligned with the slow scan axis 132. Locations of the print positions 114, the active print zones, the belts 140, the processing axis 108, and other features of the printer 100 may be stored in memory of the controller 118. Thus, the controller 118 can establish a location of the sensor 304 and a location of features detected beneath the sensor 304, such as cards 106 and card edges, relative to the print positions 114, the active print zones 300, and other the features of the printer 100.

The sensor 304 may take on any suitable form. In one embodiment, the sensor 304 includes a reflective sensor having an emitter 306 and a receiver 308, as illustrated in FIG. 1. The emitter 306 is configured to emit electromagnetic radiation 310 toward the processing axis 108, and the receiver 308 is configured to detect a reflection of the emitted electromagnetic radiation 310, as indicated by arrow 310'. The intensity of the reflected electromagnetic radiation 310' and changes in the intensity of the reflected electromagnetic radiation 310' can be used to detect the presence or absence of a card 106 beneath the sensor 304, as well as features of the cards 106, such as edges of the cards 106, for example. Other suitable types of sensors may also be used for the sensor 304, such as an optical sensor, a capacitance sensor, a camera, or other suitable type of sensor.

Figure 18:
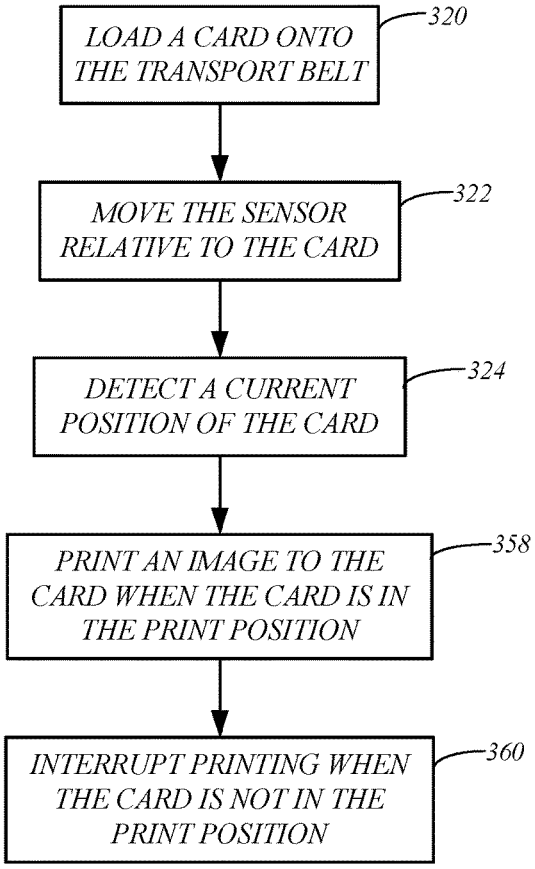
FIG. 18 is a flowchart illustrating a method of operating an ink jet card printer, in accordance with embodiments of the present disclosure.

FIG. 18 is a flowchart illustrating a method of operating the ink jet card printer 100 to ensure that each card 106 that is supported on the belt 140A or 140B is properly registered in the corresponding print position 114 before a print operation is performed, in accordance with embodiments of the present disclosure. At 320 of the method, a card 106 is loaded onto the card transport belt 140 in accordance with one or more embodiments described above. For example, a card 106A or 106B may be loaded onto a corresponding card transport belt 140A or 140B by driving the cards 106A or 106B along the processing axis 108 using the belts 140A or 140B, as discussed above and illustrated in FIG. 17. At 322, the sensor 304 is moved along with the ink jet print head 110 relative to the card 106 using the gantry 112. Note that the ink jet print head 110 and the gantry 112 are not shown in FIG. 17 in order to simplify the drawing. At 324, a current position of the card 106 relative to the processing axis 108 is detected using the sensor 304.

In some embodiments of step 322, the sensor 304 is initially moved to a position relative to the belt 140A or 140B where the detection of the presence of a card 106 by the sensor 304 indicates that the card 106 is properly registered with the print position 114. For example, the sensor 304 may be moved in step 322 to a location 326 along the processing axis 108 that is within the active print zone 300A to detect the presence of the card 106A, as shown in FIG. 17, which would indicate that the card 106A is in the print position 114. Here, a presumption is made that if the card 106 is present, then it is likely in the print position 114. While this embodiment may not be used to detect a precise location of a card 106 along the processing axis 108, the fast axis 130 or the slow axis 132, and specifically determine that the card 106 is correctly registered with the corresponding active print zone 300A, it may be used to detect various errors, such as a malfunction of the vacuum source 158 (FIG. 1) and/or a serious misfeed of the card 106, for example.

Step 322 may also involve moving the sensor 304 along a path that extends through the print positions 114 and the active print zones 300 to detect the current position of the card 106 in step 324 through the detection of a position of one or more edges of the card 106. For example, the sensor 304 may be moved along the processing axis 108 and the fast scan axis 130 and along the path indicated by arrow 328, to positions 330 and 332 to detect leading edges 334 of the cards 106A and 106B, and/or to positions 336 and 338 to detect trailing edges 340 of the cards 106A and 106B, as indicated in FIG. 17. Based on the detected position of the leading edge 334 and/or the trailing edge 340, the current positions of the cards 106A and 106B along the processing axis 108 can be determined by the controller 118 in step 324.

Additionally, the position of a card 106 relative to the processing axis 108 and along the slow scan axis 132 relative to the processing axis 108 or a corresponding belt 140 may be determined in a similar manner by moving the sensor 304 along the slow scan axis 132 and through the print position 114 and active print zone 300 of the corresponding belt 140 and detecting the position of the side edges 342 and/or 344 of the card 106, which are generally perpendicular to the edges 334 and 340. For example, as indicated in FIG. 17, a location of the side edge 342 of the card 106A may be detected by moving the sensor 304 in step 322 along a path indicated by arrow 346 that extends along the slow scan axis 132 and through a position 348, and the side edge 342 of the card 106B may be detected by moving the sensor 304 in step 322 along the path indicated by arrow 350 that extends along the slow scan axis 132 and through a position 352. Similarly, the position of the side edge 344 of the card 106A may be detected in step 324 by moving the sensor 304 along the path 346 and through a position 354, and the position of the side edge 344 of the card 106B may be detected in step 324 by moving the sensor 304 along the path 350 and through a position 356, as indicated in FIG. 17.

As a result, the current positions of the cards 106A and 106B detected using the sensor 304 in step 324 may include, for example, a position of the cards 106A and 106B along the processing axis 108 based on a detection of the leading edges 334 or the trailing edges 340, and/or a position of the cards 106A and 106B along the slow scan axis 132 relative to the processing axis 108 based on a detection of the side edges 342 or 344 of the cards 106A and 106B.

At 358 of the method, an image is printed to the card 106 using the ink jet print head 110 when the detected current position of the card 106 indicates that the card 106 is in the print position 114. In one embodiment, the card 106 is in the print position 114 when it is within the active print zone 300 and entirely covers the exposed surface 150 of the corresponding belt 140, such as illustrated by card 106A, which is within the active print zone 300A and entirely covers the belt 140A, as shown in FIG. 17.

At 360 of the method, printing is interrupted when the detected current position of the card 106 indicates that the card 106 is not in the print position. This interruption to the print operation may take on various forms. In some embodiments, the interruption in step 360 involves the controller 118 preventing the print operation from occurring in step 358. Additionally, the controller 118 may issue an error notification that is discernible by a user of the printer 100, such as a visual notification on a control panel of the printer 100, an audible notification through a speaker of the printer 100, or another suitable notification. In other embodiments, the controller 118 takes remedial action to correct the misregistration of the card 106 with the print position 114 including, for example, reloading the card 106 onto the belt 140, such as described above with reference to FIGS. 14-16. Additionally, as discussed in greater detail below, the controller 118 may adjust the active print zone 300 of the ink jet print head 110 for the misregistered card 106.

A card 106 may be considered as being in the print position 114 or the active print zone 300 of a corresponding belt 140 if the detected edge (334, 340, 342 or 344) of the card 106 is within the active print zone 300 and is within a predetermined threshold distance from a corresponding edge of the active print zone 300. Since the active print zone 300 may be slightly larger than the card surface 166 to ensure full edge-to-edge imaging of the card 106, the threshold distances may be set to ensure that the card 106 remains within the active print zone 300. If an edge of the card 106 is detected outside the active print zone 300, or within the active print zone 300 but displaced from a corresponding edge of the active print zone 300 by a distance that is greater than the threshold distance, the current position of the card 106 would indicate that the card 106 is not in the print position 114 or within the active print zone 300. Also, if an edge of the card 106 is not detected during the movement of the sensor 304, the current position would indicate that the card 106 is not in the print position 114 or an active print zone 300.

The current position of the card 106A detected through the detection of either the leading edge 334 or the trailing edge 340 of the card 106A by the sensor 304 in step 324 would indicate that the card 106A is in the print position and the active print zone 300A, because the locations of the leading edge 334 and the trailing edge 340 are within the active print zone 300A and are within a threshold distance from the corresponding edges 334' and 340' of the active print zone 300A. However, the current position of the card 106B would not indicate that it was in the print position 114 or the active print zone 300B for the belt 140B based on the detection of either the leading edge 334 or the trailing edge 340 of the card 106B, because the location of the leading edge 334 is not within the active print zone 300B, and the trailing edge 340, while within the active print zone 300B, is displaced a distance from the edge 340' of the active print zone 300B that is greater than the allowed threshold distance.

Similarly, the detection of either of the side edges 342 and 344 of the card 106A by the sensor 304 in step 324 would indicate that the card 106A is in the print position 114 and the active print zone 300A, because the locations of the leading edges 342 and 344 are within the active print zone 300A and are within a threshold distance from the corresponding edges 342' and 344' of the active print zone 300A. However, the current position of the card 106B would not indicate that it was in the print position 114 or the active print zone 300B for the belt 140B based on the detection of either the side edge 342 or the side edge 344, because while the location of the side edge 342 is within the active print zone 300B, it is displaced a distance from the corresponding edge 342' of the active print zone 300B that is greater than the threshold distance, and the side edge 344 is not within the active print zone 300B.

Accordingly, since the current position of the card 106B detected by the sensor 304 would indicate that the card 106B is not in the print position 114 or the active print zone 300B corresponding to the belt 140B, the printing would be interrupted at 360 of the method, and the controller 118 would not perform a print operation on the cards 106A and 106B in step 358. Rather, the print operation would be interrupted at step 360 due to the misregistration of the card 106B with its corresponding print position 114 and active print zone 300B. However, if the card 106B was properly registered with its print position and active print zone 300B, the controller 118 would proceed with the print operation on the cards 106A and 106B in step 358. Also, in the event that the card 106B is removed from FIG. 17 and only the card 106A is being processed, the controller 118 would proceed with a print operation on the card 106A in step 358, because the current position of the card 106A detected by the sensor 304 would indicate that the card 106A is in the print position 114 and the active print zone 300A corresponding to the belt 140A.

As mentioned above, the interruption at step 360 may involve corrective action by the controller 118 to compensate for the misregistration between a card 106 and the intended print position 114 and active print zone 300. In some embodiments, this involves shifting the active print zone 300 to a modified active print zone that is substantially aligned with the current position of the card 106. The execution of this adjustment to the location of the active print zone 300 may be limited to situations in which the card 106 is in the corresponding print position 114, in which the card 106 may entirely cover the exposed surface 150 of the belt 140, thereby ensuring that the print operation will not contaminate the surface 150 with ink.

Figure 19:
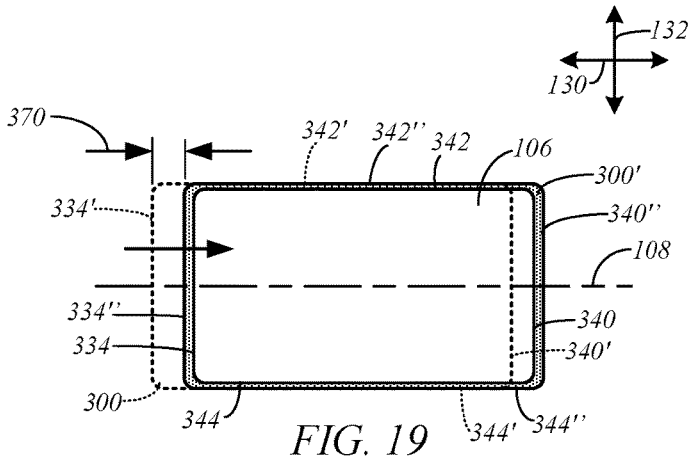
FIGS. 19 and 20 are simplified top plan views of a card relative to an active and modified print zones, in accordance with embodiments of the present disclosure.
Figure 20:
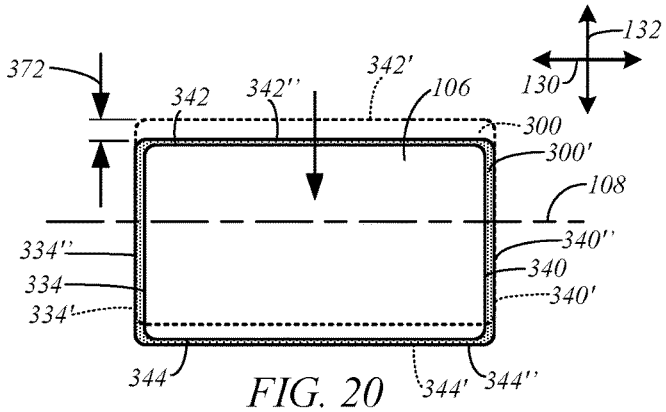

Examples of shifting the active print zone 300 to compensate for misregistration between the current position of a card 106 and the active print zone 300 of the belt 140 on which the card 106 is supported are provided in FIGS. 19 and 20, which are simplified top plan views of a card 106 relative to an active print zone 300. The belt 140 and other components are not shown in order to simplify the illustrations.

In FIG. 19, the current position of the card 106 along the processing axis 108 or fast axis 130 is offset a distance 370 from the original active print zone 300 (dashed box). This misregistration may be compensated by the controller 118 by shifting the active print zone 300 the distance 370 along the processing axis 108 to a modified active print zone 300', which is aligned with the current position of the card 106 along the processing axis 108 and fast axis 130. As a result, the edges 334 and 340 of the card 106 are within the edges 334" and 340" of the modified active print zone 300'. As mentioned above, the offset distance 370 that can be compensated by the controller 118 may be limited to ensure that the card 106 remains in the corresponding print position, in which the card entirely covers the exposed surface 150 of the corresponding belt 140.

Similarly, in FIG. 20, the current position of the card 106 along the slow scan axis 132 is offset a distance 372 from the original active print zone 300 (dashed box). This misregistration may be compensated by the controller 118 by shifting the active print zone 300 the distance 372 along the slow scan axis 132 to a modified active print zone 300', which is aligned with the current position of the card 106 along the slow scan axis 132. As a result, the edges 342 and 344 of the card 106 are within the edges 342" and 344" of the modified active print zone 300'. The offset distance 272 along the slow scan axis 132 that can be compensated by the controller 118 may be limited to ensure that the card 106 remains in the corresponding print position, in which the card 106 may entirely cover the exposed surface 150 of the corresponding belt 140.

After compensating for the misregistration of the card 106 to the active print zone 300 by shifting the active print zone 300 along the processing axis 108 and/or the slow scan axis 132 to the modified active print zone 300', the method can return to step 358 and a print operation may be performed on the card 106. Thus, this process could be used to allow a print operation to be performed on the card 106B shown in FIG. 17 if the card 106B was in the print position, in which the card 106 may entirely cover the belt 140B.

Figure 21:
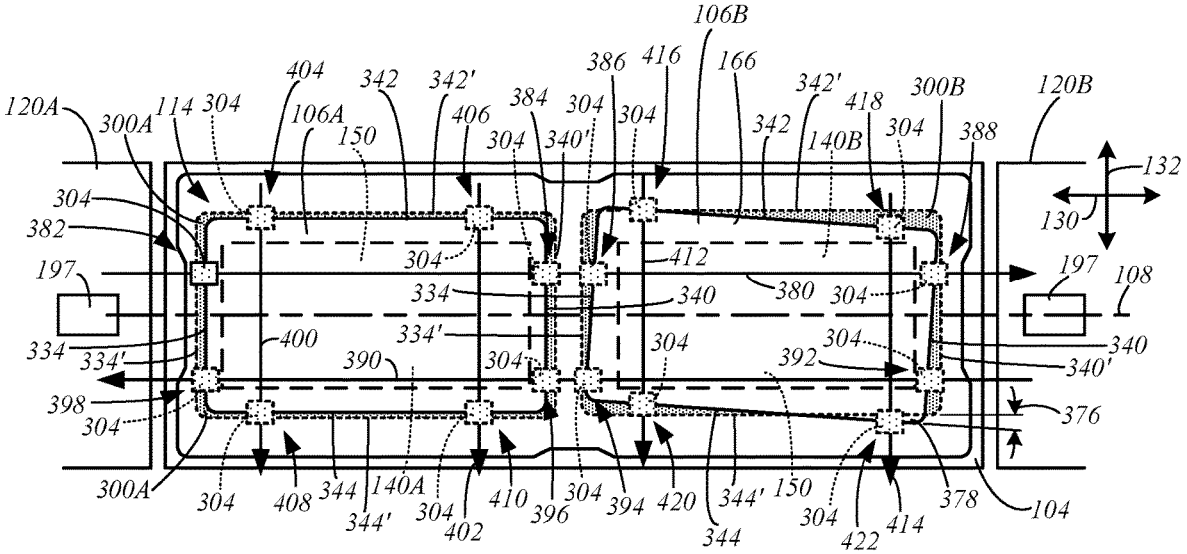
FIG. 21 is a top plan view of a card transport illustrating embodiments of the present disclosure.

Additional embodiments address misregistration between the current position of a card 106 and the active print zone 300 in the form of a skew angle between the card 106 and the active print zone 300 or the processing axis 108. FIG. 21 is a top plan view of the card transport 104 illustrating embodiments of the present disclosure, in which the current position of the card 106A is in the print position 114 and the active print zone 300A of the belt 140A, and the card 106B is in the print position of the belt 140B, but is at a skew angle 376 relative to the processing axis 108. The skew angle 376 of the card 106B may potentially result in portions of the card 106B extending beyond the active print zone 300B, such as the corner 378, as shown in FIG. 21. Accordingly, the card 106B is misregistered with the active print zone 300B. Additionally, text and/or graphics within a printed image corresponding to the active print zone 300B may be undesirably cutoff or misaligned with the edges of the card 106B due to the skew angle 376. Thus, even if the card 106B was contained within the active print zone 300B, the skew angle 376 may cause misalignment between an image printed to the card 106B and the edges of the card 106B.

In some embodiments of the method, the current position of the card 106 detected in step 324 is based on the skew angle of the card 106 relative to the processing axis 108. This may involve the detection of the location of at least two points along an edge of the card 106, such as one of the edges 334, 340, 342 or 344. For example, the sensor 304 may be moved along a path indicated by arrow 380 along the processing axis 108 and the fast scan axis 130 during step 322 to position the sensor 304 at a location 382 to detect the position along the processing axis 108 of a point on the edge 334 of the card 106A and/or a position 384 to detect the position of a point on the edge 340 of the card 106A, as indicated in FIG. 21. The sensor 304 may also be moved along the path 380 to detect a point on the edge 334 of the card 106B corresponding to a location 386 of the sensor 104 and/or a point on the edge 340 of the card 106B corresponding to a location 388 of the sensor 304, as indicated in FIG. 21. The sensor 304 may then be moved along a path indicated by arrow 390 during step 322 to allow the sensor 304 to detect the position along the processing axis 108 of a point on the edge 340 of the card 106B corresponding to a location 392 of the sensor 304 and/or a point on the edge 334 of the card 106B corresponding to a location 394 of the sensor 304, and the position of a point on the edge 340 of the card 106A corresponding to a location 396 of the sensor 304 and/or a point on the edge 334 of the card 106A corresponding to a location 398 of the sensor 304. The positions of two points on the edge 334 or 340 of the card 106A, and the positions of two points on the edge 334 or 340 of the card 106B may be used by the controller to determine the skew angle of the cards 106A and 106B.

Similarly, the skew angles of the cards 106A and 106B may be determined by detecting the positions of two points along the side edge 342 and/or the side edge 344 of the cards 106A and 106B relative to the processing axis 108 by moving the sensor 304 along the slow scan axis 132 in step 322 at different locations along the processing axis 108. For example, the sensor 304 may be moved along the slow scan axis 132 across paths 400 and 402 during the moving step 322 to allow the sensor 304 to detect the positions of points at locations 404 and 406 along the edge 342 of the card 106A, or points at locations 408 and 410 along the edge 344 of the card 106A relative to the processing axis 108. Likewise, the sensor 304 may be moved along the slow scan axis 132 across paths 412 and 414 during the moving step 322 to allow the sensor 304 to detect the positions along the slow scan axis 132 of points at locations 416 and 418 along the edge 342, or points at locations 420 and 422 along the edge 344 of the card 106B relative to the processing axis 108.

The controller 118 may use the locations of the two points detected along an edge of the card 106A and 106B to determine the skew angle of the cards 106A and 106B relative to the processing axis, such as the skew angle 376 of the card 106B. Thus, the current position of the card 106 detected in step 324 may be based upon the detected skew angles of the cards 106A and 106B, each determined through at least one of the two-point edge position measurements described above.

Embodiments of the present disclosure also include alternative techniques for detecting the skew angle of a card 106 relative to the processing axis 108. In one example, a sensor 304 in the form of a camera could be used to detect the orientation of one or more edges of the card relative to the processing axis 108 to determine the skew angle of the card 106.

In the example provided in FIG. 21, the skew angle of card 106A would be approximately zero since the edges 342 and 344 of the card 106A are oriented substantially parallel to the processing axis 108 and the fast scan axis 130, and the edges 334 and 340 are oriented substantially perpendicularly to the processing axis 108 and the fast scan axis 130. However, the non-zero skew angle of 376 would be determined for the card 106B because the positions of the points along the edge 342 or the edge 344 would indicate that the edges 342 and 344 are at the skew angle 376 to the processing axis 108 and the fast scan axis 130, and the positions of the points along the edge 334 or 340 would indicate that the edges 334 and 340 are at the skew angle 376 to a line extending perpendicularly to the processing axis 108 or to the slow scan axis 132.

The detected current position of the card 106A in step 324 would allow the controller 118 to determine that the card 106A is in the print position 114 and is correctly registered with the active print zone 300A for the belt 140A. While the detected current position of the card 106B may indicate that the card 106B is registered with the print position 114 because the card 106B covers the exposed surface 150 of the belt 140B, it would also indicate that the card 106B is misregistered with the active print zone 300B due to the skew angle 376. As a result, rather than performing a print operation at step 358 on the cards 106A and 106B, an interruption to the print operation would be triggered in step 360 of the method.

Figure 22:
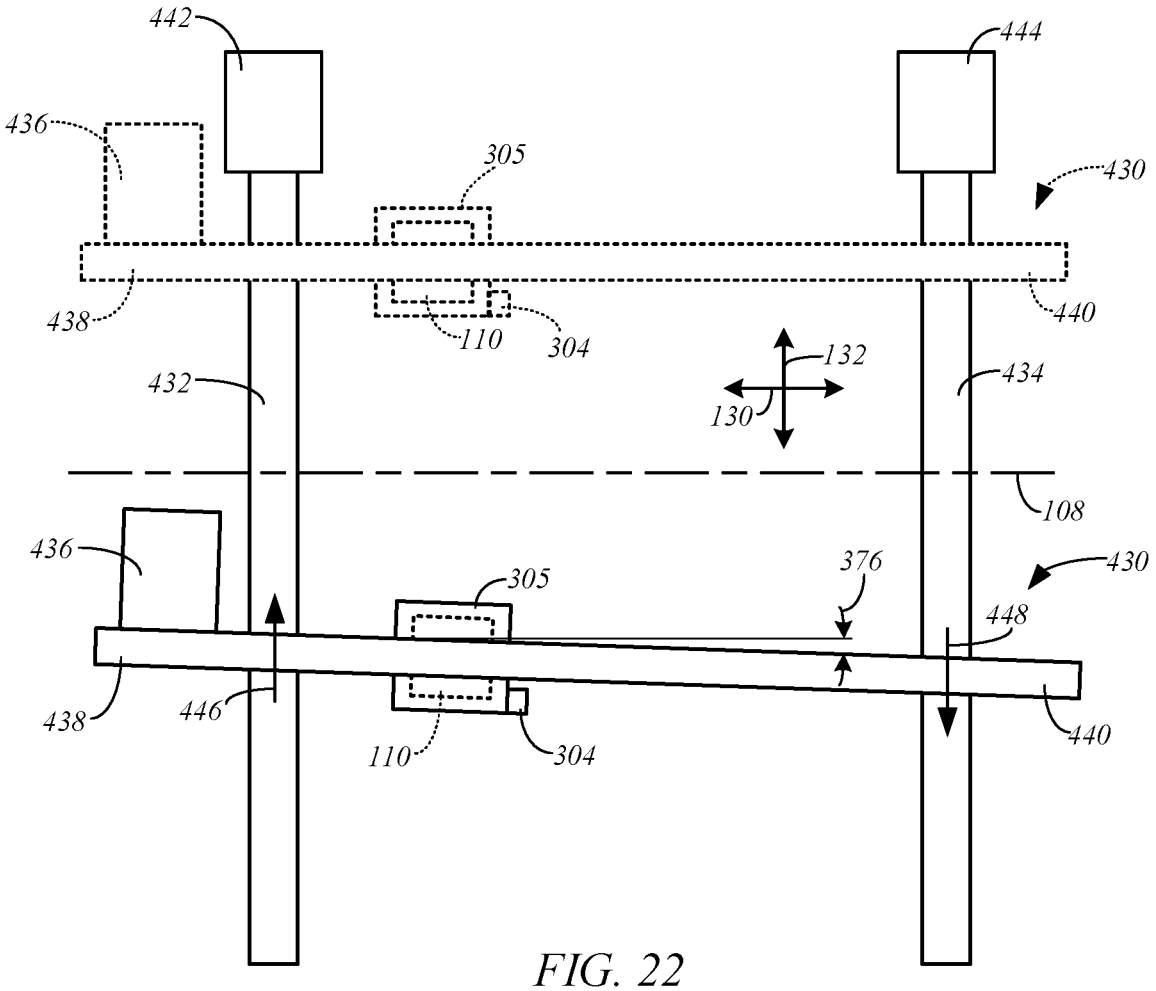
FIG. 22 is a simplified top view of a carriage mechanism of a gantry illustrating registration and misregistration between a card and an active print zone, in accordance with embodiments of the present disclosure.

In some embodiments, the misregistration of a card 106 with an active print zone 300 due to a skew angle between the card 106 and the active print zone 300 or the processing axis 108 may be compensated for by the controller 118 by shifting the fast scan axis 130 of the gantry 112 from its original position of being substantially parallel to the processing axis 108, to approximately the skew angle to the processing axis 108. In one embodiment, this is accomplished using the gantry 112, an example of which is illustrated in the simplified diagram of FIG. 22.

The gantry 112 includes a carriage mechanism 430 and drive screws 432 and 434. The carriage mechanism 430 includes a motor 436 that drives movement of the carriage 305 supporting the print head 110 and the sensor 304 along the fast scan axis 130 between ends 438 and 440 of the carriage mechanism 430, which are supported by the drive screws 432 and 434. Motors 442 and 444 respectively rotate the drive screws 432 and 434 to move the ends 438 and 440 of the carriage mechanism 430 along the slow scan axis 132. In normal operation, the drive screws 432 and 434 are rotated by the motors 442 and 444 in a synchronous manner to maintain the desired parallel relationship between the processing axis 108 and the fast scan axis 130 of the carriage mechanism 430, as indicated in phantom lines.

In one embodiment, the orientation of the carriage mechanism 430 and the fast scan axis 130 is adjusted relative to the processing axis 108 by the controller 118 using the drive screws 432 and 434 to shift the orientation of the active print zone 300 in better alignment with the skewed card 106. For example, the skew angle 376 of the card 106B in FIG. 21 may be compensated for by driving the motor 442 to move the end 438 of the carriage mechanism 430 in the direction of arrow 446, and/or driving the screw 434 using the motor 444 to move the end 440 of the carriage mechanism 430 in the opposing direction indicated by arrow 448, to align the orientation of the fast scan axis 130 of the carriage mechanism 430 at the skew angle 376 relative to the processing axis 108.

Figure 23:
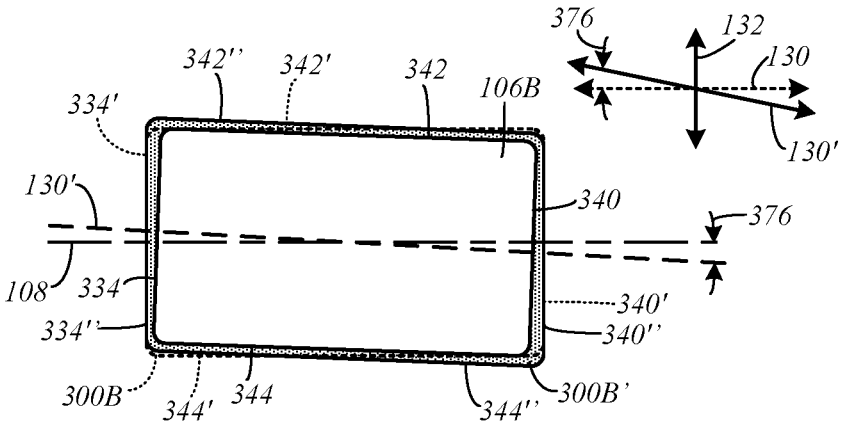
FIG. 23 is a simplified top plan view of a card and active and modified active print zones, in accordance with embodiments of the present disclosure.

This results in a shift of the active print zone 300B to a modified active print zone 300B' that is in better alignment with the card 106B due to a change in the orientation of the original fast scan axis 130 (dashed line) to a modified fast scan axis 130' that is aligned substantially parallel to the edges 342 and 344 of the card 106B, as shown in the simplified top plan view of FIG. 23. As a result, the card 106B is within the modified active print zone 300B'. Additionally, the edges 342" and 344" of the modified active print zone 300B are substantially parallel with the edges 342 and 344 of the card 106B. These adjustments result in the card 106B being registered with the modified active print zone 300B'.

Thus, after performing the skew angle compensation described above, the method can return to step 358 and a print operation may commence to print an image to the card 106B, while maintaining the orientation of the carriage mechanism 430 with the modified fast scan axis 130'. Note that this print operation may be performed when either the card 106A shown in FIG. 21 is not present, or is at a similar skew angle to the processing axis 108 as the card 106B, for example.

Thus, embodiments of the present disclosure provide solutions to the misregistration of a card 106 with a print position and/or an active print zone 300 corresponding to a belt 140. In addition to the detection of different types of card misregistration, embodiments of the present disclosure operate to compensate for misregistration between a card 106 and an active print zone 300 to allow a print operation to commence on the card 106. As a result, the ink jet card printer 100 may efficiently perform print operations due to the ability to avoid having to reload substrates, or troubleshoot and adjust mechanisms of the printer to fix card misregistration issues.

Although the embodiments of the present disclosure have been described with reference to preferred embodiments, workers skilled in the art will recognize that changes may be made in form and detail without departing from the spirit and scope of the present disclosure. It is appreciated that certain features of the present disclosure, which are, for clarity, described in the context of separate embodiments, may also be provided in combination in a single embodiment. Conversely, various features of the present disclosure, which are, for brevity, described in the context of a single embodiment, may also be provided separately or in any suitable subcombination, or as suitable in any other described embodiment of the present disclosure. Certain features described in the context of various embodiments are not to be considered essential features of those embodiments, unless the embodiment is inoperative without those elements. As used herein the term "approximately," "about" or "substantially" generally refers to ±5% of the referenced value and denotes equality with a tolerance of at most 5%, unless stated otherwise. The terms "substantially parallel" or "substantially perpendicular" refer to a tolerance of ±5 degrees, unless otherwise specified.

What is claimed is:

1. A method of operating an ink jet card printer having a transport belt, a print unit including an ink jet print head, a sensor and a gantry supporting the ink jet print head and the sensor for movement relative to the transport belt, the method comprising:

loading a card onto the transport belt including engaging the card with an exposed surface of the transport belt and driving the card along a processing axis using the exposed surface of the transport belt;

moving the sensor and the ink jet print head relative to the card using the gantry;

detecting a current position of the card relative to the processing axis using the sensor;

printing an image to the card using the ink jet print head when the detected current position of the card indicates that the card is supported on the card transport belt in an active print zone of the ink jet print head; and interrupting printing an image to the card using the ink jet print head when the detected current position of the card indicates that the card is not in the active print zone;

wherein interrupting printing an image to the card comprises:

compensating for misregistration between the detected current position of the card and the active print zone including shifting the active print zone relative to the card to a modified active print zone corresponding to the detected current position of the card; and printing an image to the card and within the modified active print zone using the ink jet print head;

wherein shifting the active print zone to the modified active print zone comprises shifting the active print zone along the processing axis and a slow scan axis that is substantially perpendicular to the processing axis.

2. The method of claim 1, wherein detecting the current position of the card comprises at least one of:

detecting a position of the card along the processing axis using the sensor;

detecting a position of the card along the slow scan axis using the sensor; and detecting a skew angle of the card relative to the processing axis using the sensor.

3. The method of claim 2, wherein detecting the current position of the card along the processing axis comprises:

moving the ink jet print head and the sensor using the gantry along a fast scan axis of the gantry, which is substantially parallel to the processing axis;

detecting a position of one of a leading edge and a trailing edge of the card, which are displaced from each other along the processing axis, using the sensor; and determining whether the card is in the active print zone based on the detected position of the leading or trailing edge.

4. The method of claim 2, wherein detecting the position of the card along the slow scan axis comprises:

moving the ink jet print head and the sensor along the slow scan axis;

detecting a position of one of a first side edge or a second side edge of the card, which are displaced from each other along the slow scan axis, using the sensor; and determining whether the card is in the active print zone based on the detected position of the first or second side edge.

5. The method of claim 2, wherein detecting the skew angle of the card relative to the processing axis comprises:

moving the ink jet print head and the sensor relative to the card using the gantry;

detecting positions of first and second points along an edge of the card using the sensor; and determining the skew angle of the card relative to the processing axis based on the detected positions of the first and second points.

6. The method of claim 2, wherein prior to printing an image to the card, the method comprises:

discharging the card from the transport belt including driving the card along the processing axis using the transport belt;

reloading the card onto the transport belt including driving the card along the processing axis using the transport belt; and detecting a new current position of the card relative to the processing axis using the sensor;

wherein printing an image to the card using the ink jet print head when the detected current position of the card indicates that the card is in the active print zone comprises printing an image to the card using the ink jet print head when the detected new current position of the card indicates that the card is in the active print zone.

7. The method of claim 2, wherein shifting the active print zone of the ink jet print head to the modified active print zone comprises adjusting an orientation of a fast scan axis of the gantry relative to the processing axis from substantially parallel to the processing axis to approximately the skew angle.

8. A method of operating an ink jet card printer having a card transport including first and second belts, and a print unit including an ink jet print head, a sensor and a gantry, the method comprising:

loading a first card onto the first belt including engaging the first card with an exposed surface of the first belt and driving the first card along a processing axis using the exposed surface of the first belt;

loading a second card onto the second belt including engaging the second card with an exposed surface of the second belt and driving the second card along the processing axis using the exposed surface of the second belt;

moving the sensor and the ink jet print head over the first and second cards using the gantry;

detecting current positions of the first and second cards relative to the processing axis using the sensor;

printing a first image to the first card and a second image to the second card during a same print operation using the ink jet print head when the detected current positions of the first and second cards indicate that the first card is supported on the first belt in a first print position, and the second card is supported on the second belt in a second print position; and interrupting printing images to the first and second cards when the detected current position of the first card indicates that the first card is not in the first print position, or when the detected current position of the second card indicates that the second card is not in the second print position.

9. The method of claim 8, wherein detecting the current positions of the first and second cards comprises at least one of:

detecting a position of the first card along the processing axis and detecting a position of the second card along the processing axis using the sensor;

detecting a position of the first card along a slow scan axis of the gantry that is substantially perpendicular to the processing axis, and detecting a position of the second card along the slow scan axis using the sensor; and detecting a skew angle of the first card relative to the processing axis, and detecting a skew angle of the second card relative to the processing axis using the sensor.

10. The method of claim 9, wherein:

printing a first image to the first card and a second image to the second card comprises printing a first image to the first card and a second image to the second card when:

the detected current positions of the first and second cards indicate that the first and second cards are respectively in the first and second print positions;

the detected current position of the first card indicates that the first card is correctly registered with a first active print zone of the ink jet print head, in which the ink jet print head is configured to print the first image; and the detected current position of the second card indicates that the second card is correctly registered with a second active print zone of the ink jet print head, in which the ink jet print head is configured to print the second image; and interrupting printing images to the first and second cards comprises:

compensating for misregistration between the detected current position of the first card and the first active print zone including shifting the first active print zone of the ink jet print head relative to the first card to a modified first active print zone corresponding to the detected current position of the first card; and printing the first image to the first card and within the modified first active print zone using the ink jet print head.

11. The method of claim 10, wherein shifting the first active print zone of the ink jet print head to the modified first active print zone comprises shifting the first active print zone along at least one of the processing axis and the slow scan axis relative to the first card.

12. The method of claim 10, wherein shifting the first active print zone of the ink jet print head to the modified first active print zone comprises shifting the first active print zone along the processing axis and the slow scan axis relative to the first card.

13. The method of claim 10, wherein shifting the first active print zone of the ink jet print head to the modified first active print zone comprises adjusting an orientation of a fast scan axis of the gantry relative to the processing axis from substantially parallel to the processing axis to approximately the skew angle of the first card to the processing axis.

14. An ink jet card printer comprising:

a card transport including a transport belt having an exposed surface configured to engage and feed a card along a processing axis;

a print unit comprising:

an ink jet print head;

a sensor; and a gantry configured to move the ink jet print head and the sensor along a fast scan axis that is parallel to the processing axis and a slow scan axis that is perpendicular to the processing axis; and a controller configured to:

load a card onto the transport belt;

detect a current position of the card relative to the processing axis using the sensor;

print an image to the card using the ink jet print head when the detected current position of the card indicates that the card is supported on the transport belt in an active print zone of the ink jet print head;

interrupt printing an image to the card using the ink jet print head when the detected current position of the card indicates that the card is not in the active print zone;

compensate for misregistration between the detected current position of the card and the active print zone including shifting the active print zone relative to the card to a modified active print zone corresponding to the detected current position of the card, wherein shifting the active print zone to the modified active print zone comprises shifting the active print zone along the processing axis and a slow scan axis that is substantially perpendicular to the processing axis; and print an image to the card within the modified active print zone using the ink jet print head.

15. The ink jet card printer of claim 14, wherein the controller is configured to detect the current position of the card by detecting at least one of:

a position of the card along the processing axis using the sensor;

a position of the card along the slow scan axis using the sensor; and a skew angle of the card relative to the processing axis using the sensor.

16. The ink jet card printer of claim 15, wherein shifting the active print zone of the ink jet print head to the modified active print zone comprises adjusting an orientation of the fast scan axis relative to the processing axis from substantially parallel to the processing axis to approximately the skew angle.

* * * * *